US005669058A

United States Patent [19]

Ito

[11] Patent Number: 5,669,058

[45] Date of Patent: Sep. 16, 1997

[54] COPYING MACHINE WITH COPYING MODES FOR COPYING ON OVERHEAD PROJECTOR SHEETS AND PAPER

[75] Inventor: Hiroyasu Ito, Okazaki, Japan

[73] Assignee: Minolta Co., Ltd., Osaka, Japan

[21] Appl. No.: 733,073

[22] Filed: Oct. 16, 1996

Related U.S. Application Data

[63] Continuation of Ser. No. 394,611, Feb. 22, 1995, abandoned.

[30] Foreign Application Priority Data

Feb. 24, 1994 [JP] Japan ..... 6-053152

[51] Int. Cl.[6] ..... G03G 15/00

[52] U.S. Cl. ..... 399/382; 399/391

[58] Field of Search ..... 399/382, 391, 399/45; 358/450, 451

[56] References Cited

U.S. PATENT DOCUMENTS

| | | | |
|---|---|---|---|
| 4,648,709 | 3/1987 | Bushaw | 355/311 |
| 4,681,428 | 7/1987 | Devoy | 355/311 |
| 4,935,771 | 6/1990 | Ito | 355/66 |
| 5,136,341 | 8/1992 | Takemura et al. | 355/311 |
| 5,384,632 | 1/1995 | Nakajima et al. | 355/313 |
| 5,481,353 | 1/1996 | Hicks et al. | 355/311 |

FOREIGN PATENT DOCUMENTS

| | | |
|---|---|---|
| 62-59971 | 3/1987 | Japan . |
| 4-362968 | 12/1992 | Japan . |

*Primary Examiner*—William J. Royer
*Attorney, Agent, or Firm*—Burns, Doane, Swecker & Mathis, LLP

[57] ABSTRACT

An image forming apparatus includes an image forming unit for optically scanning a document to accomplish an image formation, a first paper supply port for accommodating a batch of OHP sheets, a second paper supply port for accommodating a batch of copying papers. A first selector is used to set an OHP copy mode as one operation relative to one document during which, after a copy paper supplied from the second paper supply port has been discharged, an OHP sheet is supplied from the first paper supply port and is, after an image has been formed thereon by the image forming unit, discharged. A second selector is operable to set a multi-copy mode in which using the copy papers accommodated in the second paper supply port a multiple copy is carried out, and a third selector is operable to set a copying condition. The copying condition is controlled by a control unit so as to be applied only during the multi-copy mode, set by the second selector, when the OHP copy mode is set by the first selector and, at the same time, the multi-copy mode is set by the second selector.

7 Claims, 17 Drawing Sheets

COPYING MACHINE WITH COPYING MODES FOR COPYING ON OVERHEAD PROJECTOR SHEETS AND PAPER

This application is a continuation of application Ser. No. 08/394,611, filed Feb. 22, 1995, now abandoned.

BACKGROUND OF THE INVENTION

1. Field of the Invention

The present invention generally relates to a copying machine and, more particularly, to the copying machine of a type capable of continuously copying an image of at least one document onto an OHP sheet and also onto a standard paper and also capable of executing copying on the OHP sheet and copying on the standard paper under various operating modes.

It is to be noted that the term "OHP sheet" hereinabove and hereinafter is intended to mean a transparent, or substantially transparent, sheet which, after an image of the document has been reproduced thereon, is used in an overhead projector so that the image on the OHP sheet can be optically projected onto a screen for presentation to an audience.

2. Description of the Prior Art

The Japanese Laid-open Patent Publication No. 62-59971 discloses a copying machine of a type having a capability wherein when an OHP copy mode is commanded by an operator of the copying machine, a blank paper can be discharged onto a copy receiving tray so as to overlay an OHP sheet which has previously been copied with an image of a document.

The Japanese Laid-open Patent Publication No. 62-141576 discloses a copying machine of a type having a capability wherein the OHP sheets and the standard papers are alternately supplied so that, while an image of a document is reproduced on each of the OHP sheets, the blank paper is discharged with no document image reproduced thereon or with the document image reproduced thereon depending on a command inputted through an input means.

The Japanese Laid-open Patent Publication No. 4-362968 discloses an image recording apparatus of a type wherein when selection of an OHP copy mode and a multi-copy making are ordered, the OHP blank papers are successively discharged onto a copy receiving tray so as to alternate the OHP sheet bearing the document images and, also, a standard copying operation is carried out to the standard papers a number of times corresponding to the number of copies desired which has been inputted.

When an image of the document is to be copied on an OHP sheet, it often occurs that copies of the same document image on standard papers should be made for distribution to, for example, an audience. It also often occurs that the copied papers for distribution to the audience should be of a size different from that of the OHP sheet bearing the same document image or that for saving purpose different images of the documents should be copied on the opposite sides of each paper, respectively.

In order to meet these requirements, the copying machine should be of a design wherein a copying operation to produce a copied OHP sheet and a multi-copy operation to produce copies made on the standard papers can be carried out continuously and wherein an OHP copy mode for making a copy on the OHP sheet and a standard copy mode for making the copies on the standard papers can be selected separately. However, the copying machine disclosed in any one of the above mentioned prior art references is ineffective to fulfill these requirements.

More specifically, the copying machine disclosed in the Japanese Laid-open Patent Publication No. 62-59971 is ineffective to make a copy on the OHP sheet and on each standard paper for distribution to the audience at the same time. The copying machine disclosed in the Japanese Laid-open Patent Publication No. 62-141576 is also ineffective to make two or more copies on the standard papers for distribution to the audience. Also, the copying machine disclosed in the Japanese Laid-open Patent Publication No. 4-362968 is of a design wherein the OHP copy mode and the standard copy mode cannot be differentiated.

SUMMARY OF THE INVENTION

The present invention is accordingly intended to provide an improved copying machine of a type capable of continuously copying an image of at least one document onto an OHP sheet and also onto a standard paper and also capable of differentiating the OHP copy mode and the standard copy mode from each other.

In order to accomplish this object, the present invention provides an image forming apparatus which includes an image forming means for optically scanning a document to accomplish an image formation, a first accommodating means for accommodating a batch of OHP sheets, a second accommodating means for accommodating a batch of copying papers. A first setting means is used to set an OHP copy mode as one operation relative to one document during which, after a copy paper supplied from the second accommodating means has been discharged, an OHP sheet is supplied from the first accommodating means and is, after an image has been formed thereon by the image forming means, discharged. A second setting means is operable to set a multi-copy mode in which using the copy papers accommodated in the second accommodating means a multiple copy is carried out, and a third setting means is operable to set a copying condition. The copying condition is controlled by a control means so as to be applied .only during the multi-copy mode, set by the second setting means, when the OHP copy mode is set by the first setting means and, at the same time, the multi-copy mode is set by the second setting means.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Before the description of preferred embodiments of the present invention proceeds, terms "A-scan" and "B-scan" used hereinafter will first be defined. Referring first to FIG. 12B, there is shown the layout of an oblong document support platen of a copying machine. Assuming that scanning of a document placed on the platen starts from a home position defined at a location adjacent a right-hand end of the platen, the term "A-scan" means a mode of operation in which the scanning takes place in an area (an A-scan position) of the platen adjacent the home position whereas the term "B-scan" means a mode of operation in which the scanning takes place in a different area (a B-scan position) on one side of the A-scan position remote from the home position.

First Embodiment (FIGS. 1 to 12B)

[1] Copying Machine

Figure 1:
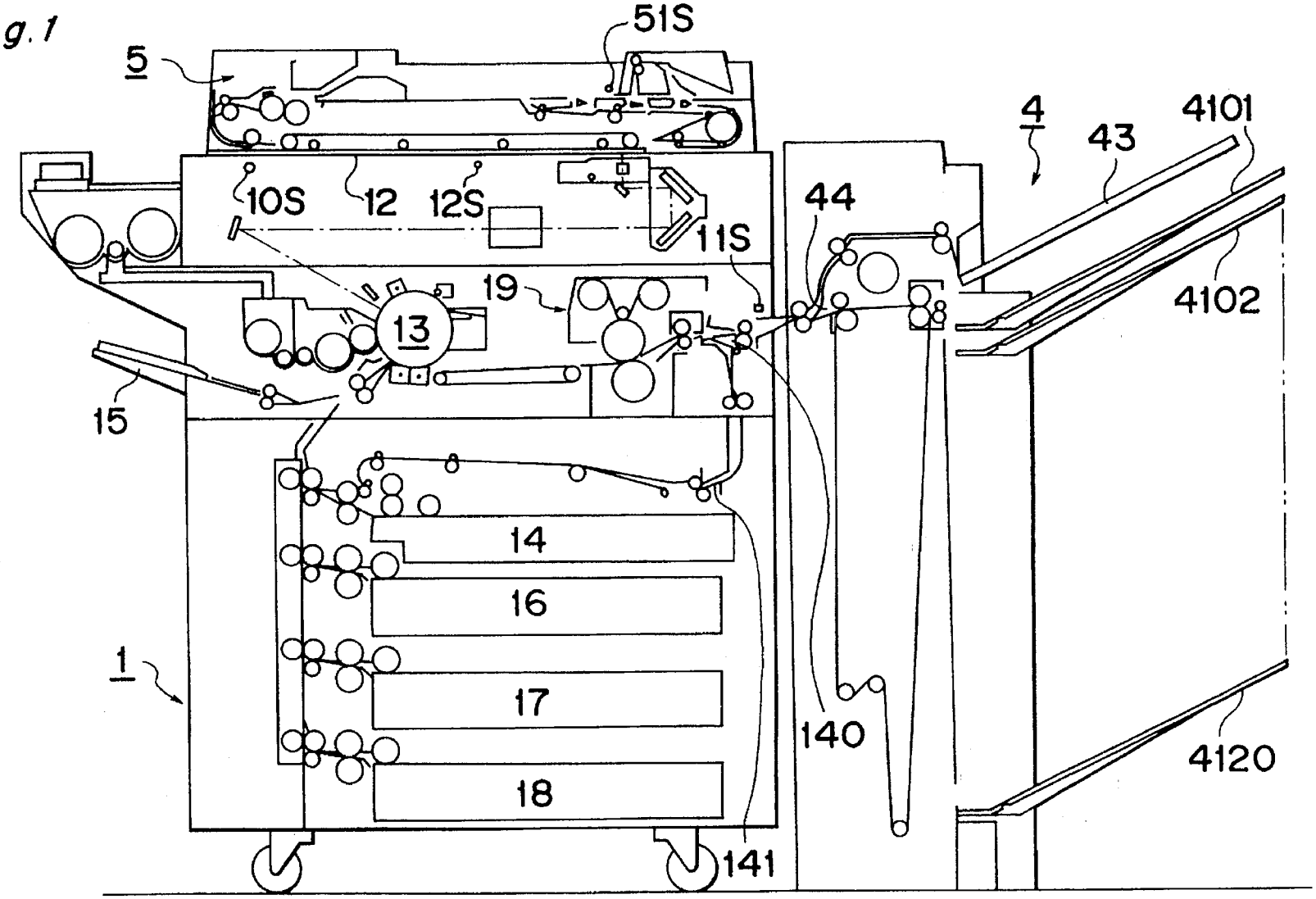
FIG. 1 is a schematic diagram showing an electrophotographic copying machine which may be employed in the practice of the present invention.

A copying machine employed in the practice of the present invention includes, as shown in FIG. 1, an electrophotographic copier 1 having an automatic document feeder (ADF) 5 mounted atop the copier 1 and a sheet sorter unit 4 operatively coupled with the copier 1 for receiving and sorting copies from the copier 1 in a collated fashion. The automatic document feeder 5 may be of any known structure and is shown to be of a circulating type, but may be of a noncirculating type.

The copier 1 has an oblong document support platen 12 for the support of a document thereon. The document placed on the platen 12 with an imagewise side thereof facing downwardly is scanned by an illuminator to produce imagewise rays of light which are subsequently guided through an optical system towards a photosensitive surface of a photoreceptor drum 13 along an optical path shown by the phantom line. During rotation of the photoreceptor drum 13 in one direction, an electrostatic latent image corresponding to the image born on the document is formed on the photosensitive surface of the photoreceptor drum 13 at an exposure station and is subsequently developed into a visible toner image at a developing station. The visible toner image is transferred onto a copying paper at a transfer station and is fixed on the copying paper by a fixing unit 19 at a fixing station to thereby produce a copy which is subsequently discharged from the copier 1 to the sorter unit 4 or onto an intermediate tray 14 in the case where the copier 1 is set in a duplex copy mode. The electrophotographic process followed by the copier 1 is well known to those skilled in the art and, therefore, the details thereof are not herein reiterated for the sake of brevity.

The illustrated copier 1 has a manual feed tray 15, the intermediate tray 14 and a plurality of standard paper supply bins 16, 17 and 18. The manual feed tray 15 is, in the illustrated embodiment, used to feed OHP sheets therefrom while the standard paper supply bin 16 is utilized to accommodate a batch of blank papers that are eventually placed between neighboring OHP sheets of a size equal to that of the blank paper. The other standard paper supply bins 17 and 18 are used to supply standard papers therefrom when the copier 1 is set in a 2-in-1 copy mode and a duplex copy mode, respectively. It is to be noted that although in the illustrated embodiment the copier 1 is shown to have three standard paper supply bins, the number thereof may not be always limited thereto and four or more paper supply bins may be used. It is also to be noted that the standard paper supply bins 16 to 18 are used to accommodate respective batches of standard papers of a different size and/or orientation.

Figure 3:
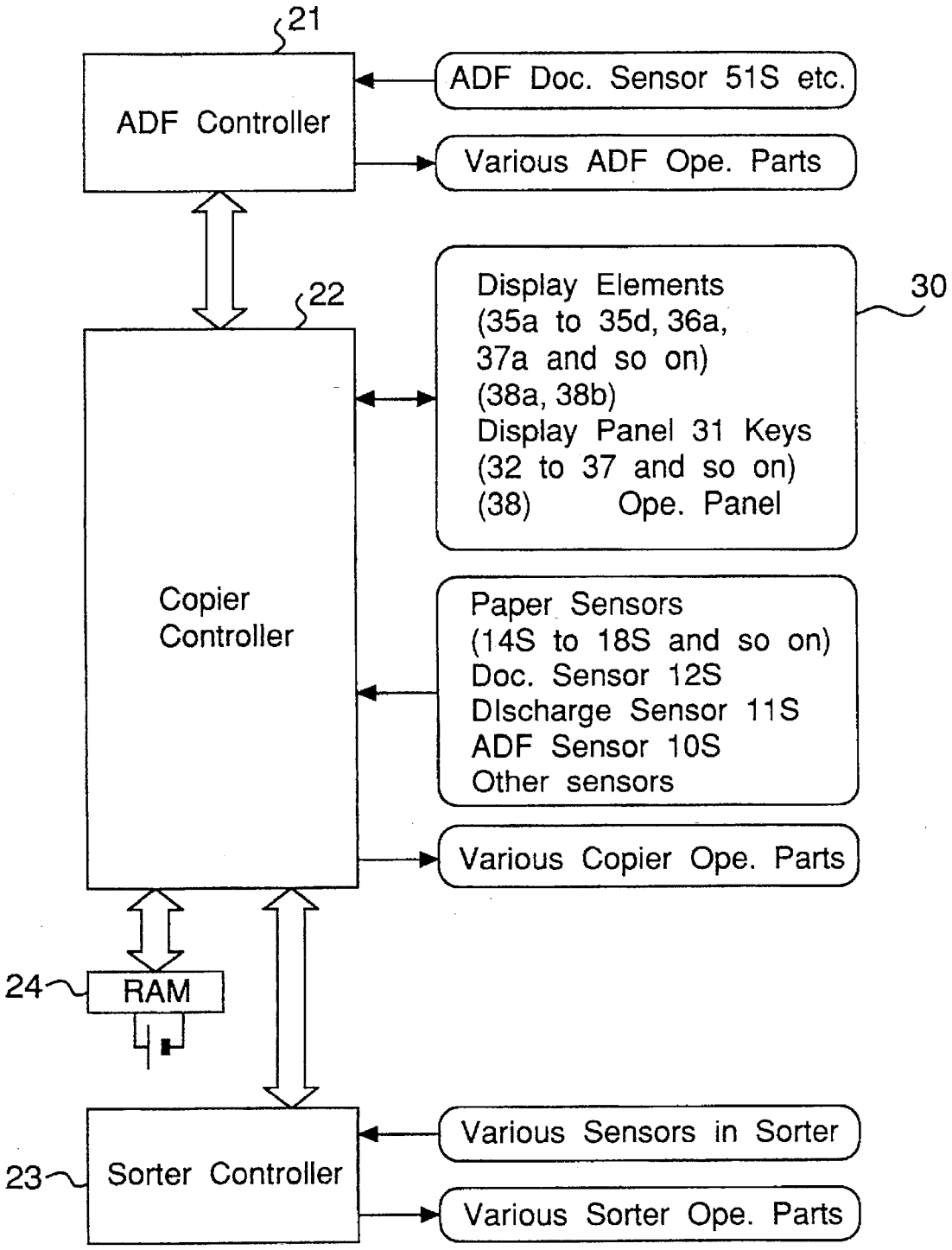
FIG. 3 is a circuit block diagram showing a control circuit employed in the copying machine of FIG. 1.

The copier 1 makes use of a plurality of sensors that provide respective detection signals which are in turn supplied to a copier controller 22 as shown in FIG. 3 for controlling various component parts of the copying machine as will be described later. By way of example, the copier 1 is provided with an ADF sensor 10S for detecting whether or not the automatic document feeder 5 is coupled, a copier discharge sensor 11S for detecting discharge of a copied paper from the copier 1, and a document sensor 12S for detecting the presence or absence of the document placed on the platen 12.

The copier 1 is provided with a switching pawl 140 operable to direct the copied paper towards a copy receiving tray 43 or towards the intermediate tray 14, and also with a reversing pawl 141 capable of assuming one of a first operative position, in which the copied paper to be supplied onto the intermediate tray 14 is supplied with the imagewise side thereof oriented upwardly, and a second operative position in which the copied paper to be supplied onto the intermediate tray 14 is supplied with the imagewise side thereof oriented downwardly. Where the copied paper is supplied with the imagewise side thereof oriented upwardly, the illustrated copying machine executes the duplex copy mode in which the copied paper bearing an image on one side thereof is again copied with an identical or different image on the opposite side thereof.

Figure 2:
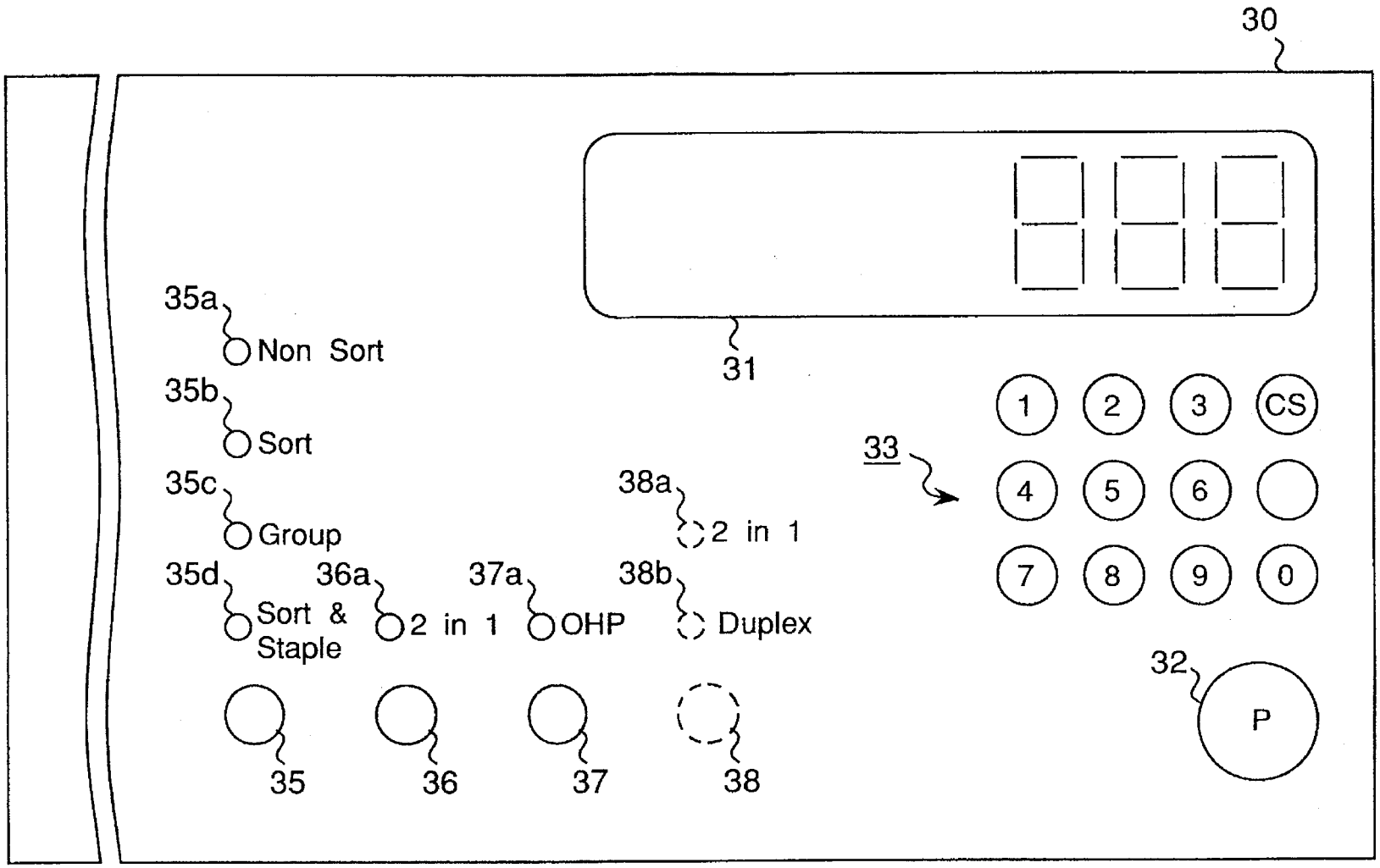
FIG. 2 is a schematic plan view showing a control panel employed in the copying machine shown in FIG. 1.

An operating panel 30 such as shown in FIG. 2 is mounted atop the copier 1 at a location convenient for an operator to look at. This control panel 30 has a sort mode key 35 for switching over one of sort modes; sort mode indicators 35*a*, 35*b*, 35*c* and 35*d* each in the form of a light emitting diode for providing a visual indication of one of the sort modes then selected; a 2-in-1 mode key 36 for selectively enabling and disabling a 2-in-1 copy mode; a 2-in-1 mode indicator 36*a* in the form of a light emitting diode for providing a visual indication the 2-in-1 copy mode having been selected; an OHP mode key 37 for selectively enabling and disabling an OHP copy mode; an OHP mode indicator 37*a* in the form of a light emitting diode for providing a visual indication of the OHP copy mode having been selected; a print key 32 for issuing a print command to start a copying operation; a plurality of numerical input keys generally identified by 33; a display panel 31 for providing a visual indication of the number of copies desired to be made; and others.

It is to be noted that a key represented by a phantom circle 38 and related LED (light emitting diode) indicators also represented by phantom circles 38*a* and 38*b* are utilized in the copying machine in the practice of a second preferred embodiment of the present invention in place of the 2-in-1 mode key 36 and the related 2-in-1 mode indicator 36*a*. The key 38 is a 2-in-1/duplex/standard copy mode selector key and the LED indicators 38*a* and 38*b* when turned on provide respective visual indications of the 2-in-1 copy mode and the duplex copy mode then selected.

Outputs from the various keys on the control panel 30 are supplied to the copier controller 22 as shown in FIG. 3 and are utilized for various controls as will be described later. The copier controller 22 controls energization or deenergization of the various LED indicators on the control panel 30 and a display of the display panel 31 in a manner as will be described later.

The automatic document feeder 5 is of a design wherein the document placed in a document tray is automatically fed onto the platen 12 with an imagewise side thereof oriented towards the platen 12 and is, after the document on the platen 12 has been scanned, discharged to the outside of the automatic document feeder 5 automatically. Since the automatic document feeder 5 may be of any known construction and is well known to those skilled in the art, the details thereof are not herein reiterated for the sake of brevity. In any event, however, the automatic document feeder 5 is provided with various sensors providing detection signals which are in turn supplied, as shown in FIG. 3, to an ADF controller 21 and also to the copier controller 22 by way of the ADF controller 21 for controlling various component parts as will be described later. The sensors built in the automatic document feeder 5 include, inter alia, an ADF document sensor 51S for detecting the presence or absence of the subsequent document to be copied. The sorter unit 4 is controllably connected with the copier controller 22 through a sorter controller 23.

The sorter unit 4 is so designed as to direct copied papers successively discharged from the copier 1 to the copy receiving tray 43 or at least one of sorter trays 4101 to 4120. A switching pawl 44 in the sorter unit 4 serves to direct each copied paper towards the copy receiving tray 43 or towards at least one of the sorter trays 4101 to 4120. The direction of feed of the copied paper either to the copy receiving tray 43 or to at least one of the sorter trays 4101 to 4120 is controlled in a manner as will be described later. In any event, the sorter unit 4 may be of any known construction and, therefore, the details thereof are not herein reiterated for the sake of brevity.

[2] Machine Control

A term "on-edge" used hereinafter is intended to mean a timing at which a signal changes from an OFF state to an ON state, and a term "end-edge" also used hereinafter is intended to mean a timing at which an operating condition changes to a non-operating condition.

According to the first preferred embodiment of the present invention, when the OHP copy mode is selected and the machine is instructed to make two or more copies, processes associated respectively with a blank paper and an OHP sheet are carried out with respect to the documents at the A-scan and B-scan positions and, thereafter, a 2-in-1 copying of the two documents at the A-scan and B-scan positions is carried out automatically to produce a copy, the number of which is equal to the number of copies desired to make less one (1). The 2-in-1 copying means an operation in which the two documents placed on the platen 12 in side-by-side fashion are copied on a single standard paper. It is to be noted that, in the practice of the first preferred embodiment of the present invention, it is possible to set the 2-in-1 copy mode without setting the OHP copy mode and, in such case, a conventional process for the standard 2-in-1 copy mode is carried out.

Figure 4:
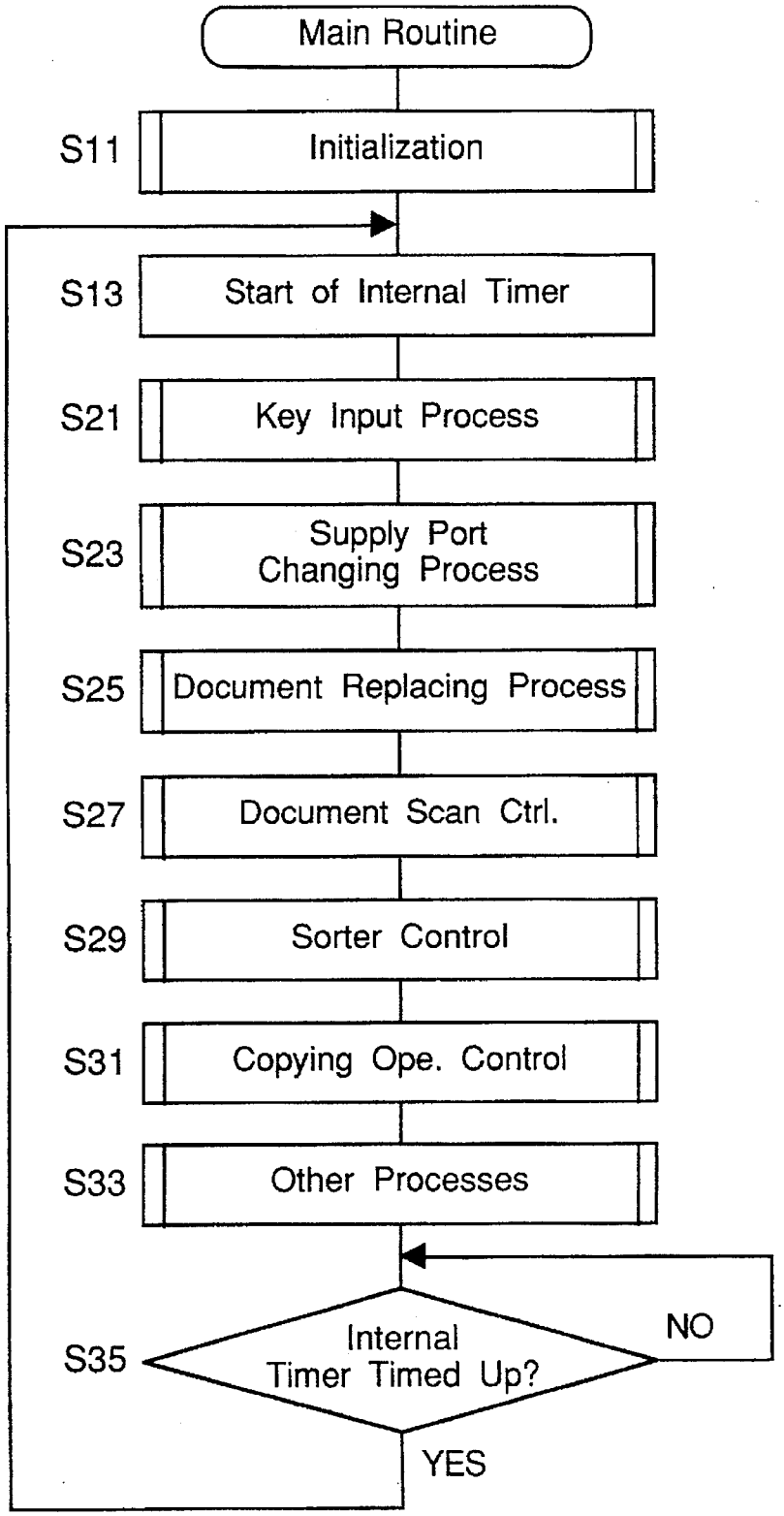
FIG. 4 is a flowchart showing a main routine of operation performed by the copying machine of FIG. 1.

[2-1] Main Routine (FIG. 4)

Referring to FIG. 4, when the process is started as a result of the machine having been electrically powered, an initialization process takes place at step S11 to clear the random access memory 24. At this time, setting of a paper supply port and others is set to a default port. A flow from step S21 to step S33 is cyclically executed until a preset time set in an internal timer at step S13 terminates at step S35.

During execution of the key input process at step S21, a process necessary to change modes according to key inputting from the operating panel 30 is carried out, the details of which will be described later. During execution of a paper supply port changing process, a process at step S23 for changing the paper supply port is carried out in response to either the on-edge of the print key 32 or the end-edge of a paper supply, the details of which will be described later. During execution of a document replacing process at step S25, the visual indication of the desired number of copies to be made that is displayed is reset to zero, a process for replacing the document on the platen 12 with a different document is carried out, the details of which will be described later. During execution of a document scan control at step S27, a process for accomplishing the A-scan or B-scan at a document scan timing is carried out, the details of which will be described later. Finally, during execution of a sorter control at step S29, a process for selecting one of the trays to which the copied paper is to be discharged from the copier 1 is carried out, the details of which will be described later.

During execution of the control of the copying operation at step S31, various processes necessary to accomplish the copying operation performed by the copying machine (such as control of various components disposed around the photoreceptor, control of the fixing unit, supply and control of copying papers and so on) are performed. Since these processes are well known to those skilled in the art, no description thereof is herein reiterated for the sake of brevity. During execution of other processes at step S33, various known controls necessary to control the copying machine other than the above mentioned processes are performed.

Figure 5:
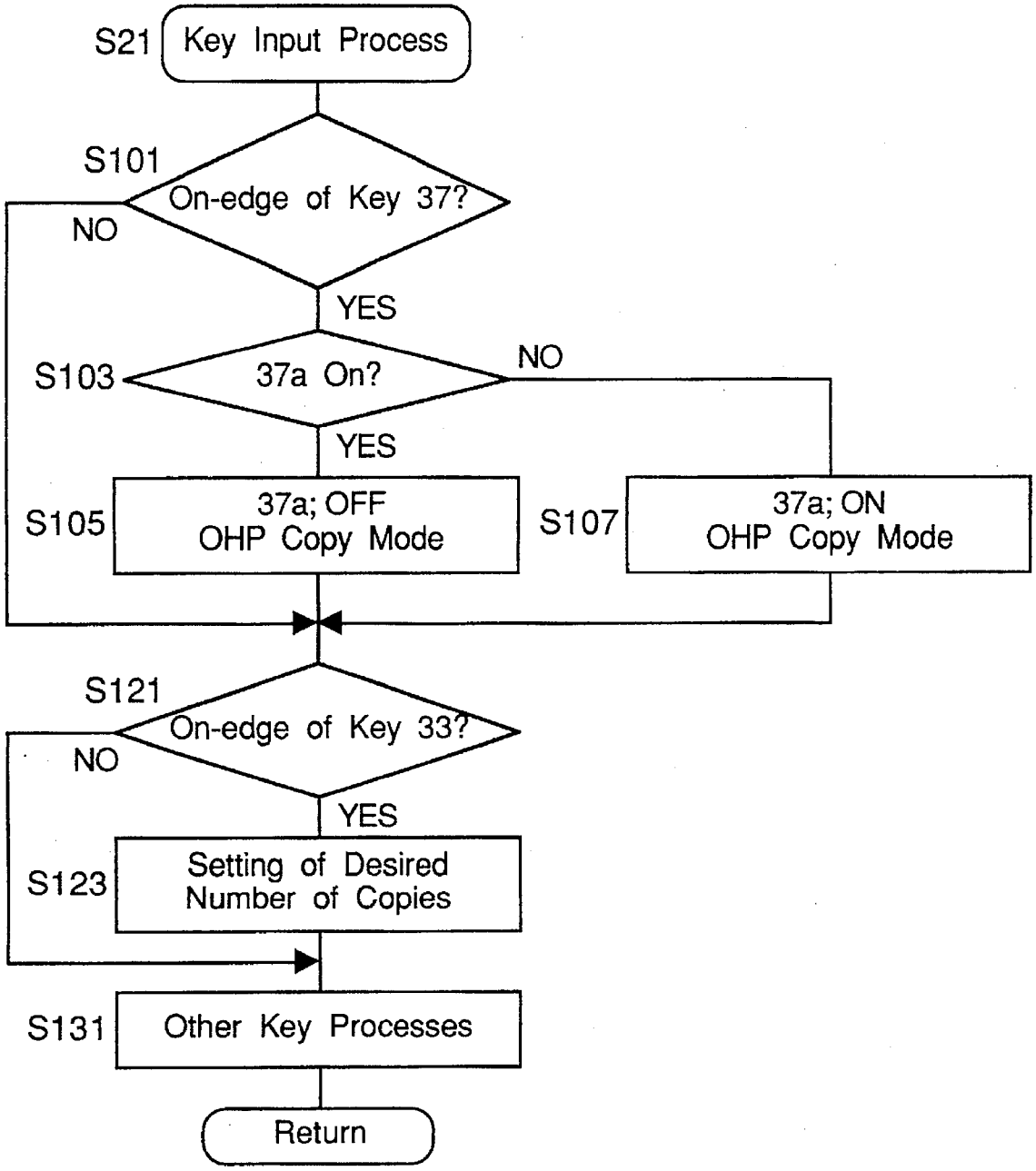
FIG. 5 is a flowchart showing a key input processing routine executed by the copying machine according to a first preferred embodiment of the present invention.

[2-2] Key Input Process (FIG. 5)

When the en-edge of the OHP mode key 37 is detected as indicated by "YES" at step S101, the OHP mode indicator 37*a* is determined. As a result thereof, when the OHP copy mode is set, that is, when the OHP mode indicator 37*a* is lit as indicated by "YES" at step S103, the OHP mode indicator 37*a* is switched off and the OHP copy mode is disabled at step S105. On the other hand, if the decision step S103 has indicated that the OHP mode indicator 37*a* is switched off as indicated by "NO", the OHP mode indicator 37*a* is switched on and the OHP copy mode is enabled at step S107.

When the on-edge of any one of the numerical input keys 33 is detected as indicated by "YES" at step S121, a numerical value corresponding to the numerical input key then detected is set at step S123 as the number (multi-copy number) of copies desired for one document. It is to be noted that one document during the 2-in-2 copying means two sheets of documents placed on the document support platen in side-by-side fashion as shown in FIG. 12B. Also, the number of copies made during the OHP copy mode equals to the numerical value inputted as the desired number of copies to be made, less 1.

At step S131, key input processes other than that described above are carried out.

Figure 6:
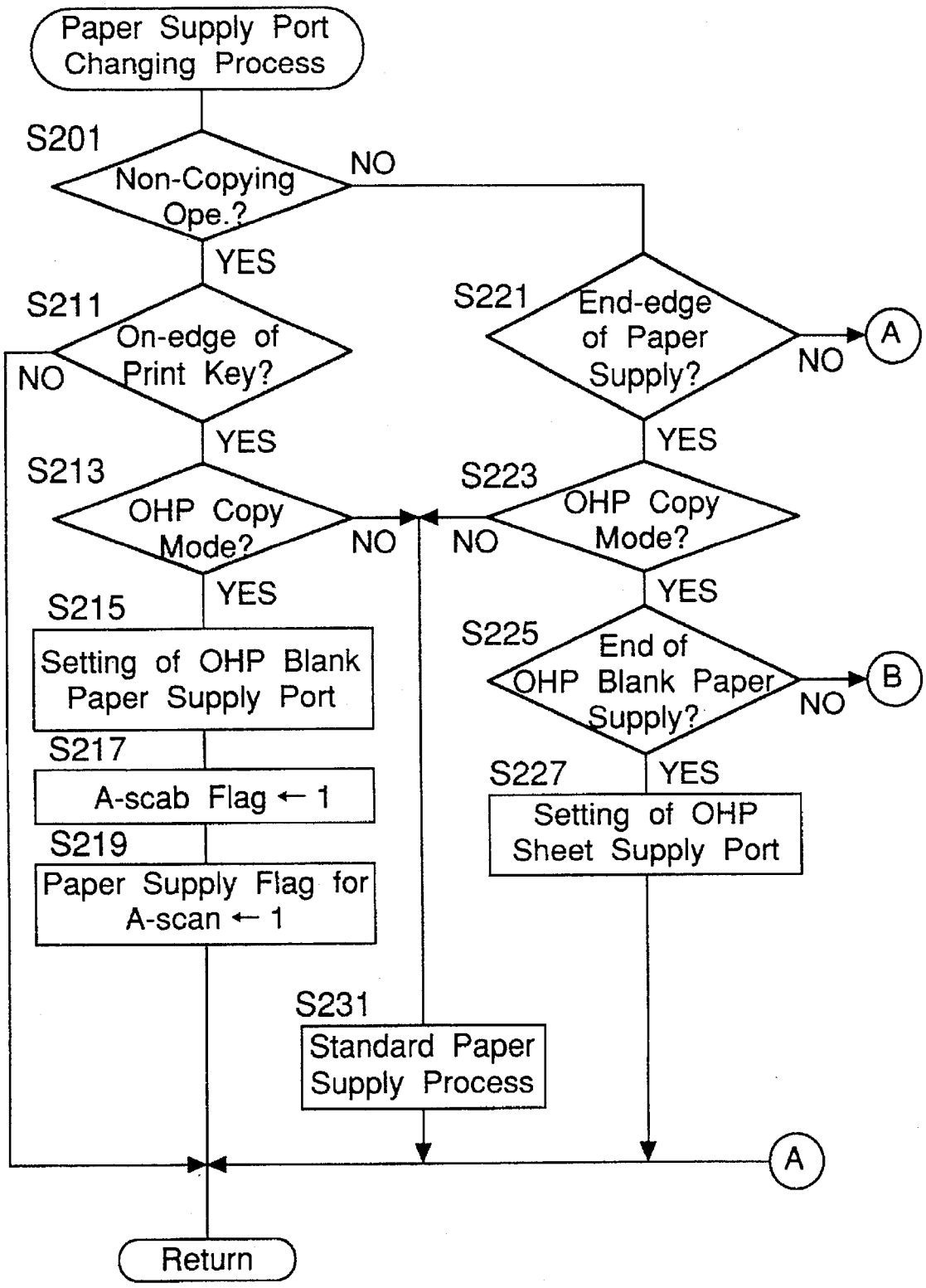
FIG. 6 is a flowchart showing a portion of a cassette changeover routine executed by the copying machine according to the first preferred embodiment of the present invention.
Figure 7:
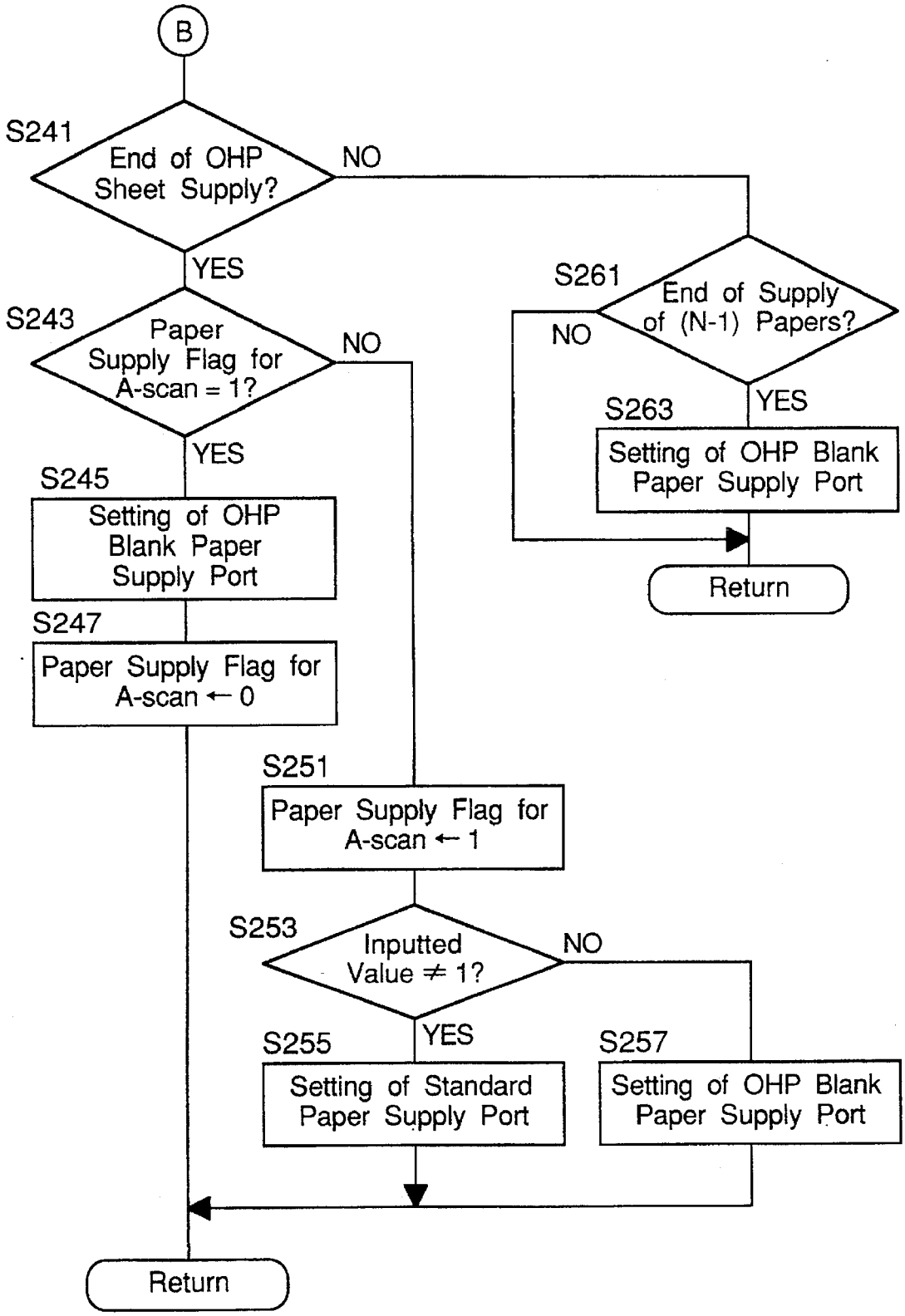
FIG. 7 is a flowchart showing the remaining portion of the cassette changeover routine shown in FIG. 6.

[2-3] Paper Supply Port Changing Process (FIGS. 6 and 7)

This process will be described separately according to whether the OHP copy mode (OHP Copy Mode) is enabled or whether the OHP copy mode is disabled (Non-OHP Copy Mode).

[2-3-1] OHP Copy Mode

When during non-copying operation as indicated by "YES" at step S201, the on-edge of the print key 32 is detected as indicated by "YES" at step S211, decision is made at step S213 to determine if the OHP copy mode is enabled. Since in this case the OHP copy mode is enabled as indicated by "YES" at step S213, the OHP blank paper supply port is set at step S215, an A-scan flag is set to be 1 at step S217, and a paper supply flag for the A-scan is set to be 1 at step S219. It is to be noted that the paper supply port so set is stored in the random access memory 24 shown in FIG. 3. In the description that follows, a similar description applies and, therefore, it will not be reiterated for the sake of brevity. It is to be noted that in the above description, setting of the A-scan flag to be 1 means that the document held in the A-scan position (See FIG. 12B) is to be scanned and that setting of the paper supply flag for the A-scan to be 1 means that the OHP sheet onto which the document held in the A-scan position has not yet been supplied.

On the other hand, when during the copying operation as indicated by "NO" at step S201 the end-edge of the paper supply is detected as indicated by "YES" at step S221, decision is made to determine if the OHP copy mode is enabled. Since in this case the OHP copy mode is enabled as indicated by "YES" at step S223, the program flow proceeds to step S225 at which decision is made to determine if the supply of the OHP blank paper is completed. At this time the supply of the OHP blank paper has already been completed (See S225; YES/S215) and, therefore, the OHP sheet supply port for the subsequent feed is set at step S227.

If during the copying operation taking place after execution of step S227 as indicated by "NO" at step S201, the end-edge of the paper supply is detected as indicated by "YES" at step S221, it means that the supply of the OHP sheet is completed (S223;YES, and, S225;NO, and, S241;YES) and the program flow therefore proceeds to step S243.

At step S243, the paper supply flag for the A-scan is determined. At this time, the paper supply flag for the A-scan is 1 (See S243;YES/S219). For this reason, in order that a sheet (OHP blank paper/subsequent OHP sheet) corresponding to the document held at the B-scan position is supplied during the subsequent paper supply, the paper supply port for the OHP blank papers is set at step S245. Also, since the supply of the OHP sheet onto which the document held at the A-scan position is to be copied has been completed (See steps S221 to S241;YES), the paper supply flag for the A-scan is set to zero at step S247.

In the event that during the copying operation taking place after execution of step S245 as indicated by NO at step S201 the end-edge of the paper supply is detected as indicated by YES at step S221, it means that the supply of the OHP blank paper has been completed (S223;YES, and, S225;YES) and, therefore, the supply port for the OHP sheets is set at step S227. This OHP sheet is the one onto which the document held at the B-scan position is to be copied.

In the event that the end-edge of the paper supply is detected as indicated by YES at step S221 during the copying operation taking place after execution of step S247 and also after execution of step S227 as indicated by NO at step S201, it means that the supply of the OHP sheet onto which the document held at the B-scan position is to be copied has been completed (S223;YES, and, S225;NO, and, S241;YES) and, therefore, the paper supply flag for the A-scan is zero as indicated by NO at step S243. In this case, the paper supply flag for the A-scan is set to be 1 at step S251. In other words, the paper supply flag for the A-scan is set to be 1 so that the paper supply subsequent to the supply of the sheet (OHP blank paper and OHP sheet) associated with OHP is carried out in two sets, that is, so that the paper supply can be carried out for each of the respective documents held at the A-scan and B-scan positions.

Thereafter, the numerical value which has been set as the number of copies desired to be made is determined at step S253. Where the desired number of copies is greater than 1 as indicated by YES at step S253, that is, in the case; where a multi-copy mode is set, the standard paper supply port is set at S255. This is the paper supply port where papers capable of being copied with two documents currently placed on the platen at one time are accommodated. In this; way, the copying operation that takes place thereafter is carried out under the 2-in-1 copy mode with respect to the standard copying papers.

On the other hand, where the desired number of copies to be made which has been entered the copying machine is one (1) as indicated by "NO" at step S253, the supply port for the OHP blank papers is set at step S257. This is a paper supply corresponding to one of the document on the platen which is held at the A-scan position. In other words, in such case (not under the multi-copy mode), processes associated only with the OHP blank papers are carried out.

Where during the copying operation (S201 ;NO) after execution of step S255 the end-edge of the paper supply is detected as indicated by "YES" at step S221, it means that the supply of the standard paper has been completed (S223;YES, and, S225;NO, and, S241;NO) and the program flow therefore proceeds to step S261.

At step S261, decision is made to determine if the standard copying papers of a number equal to the inputted numerical value less 1 from have been completely supplied from the standard paper supply port, that is, if supply of all of the standard papers with respect to the document then placed on the platen has been completed. If it has not yet been completed .as indicated by "NO" at step S261, the program flow returns to the main routine and the identical program flow is repeated until it is completed. In other words, the document then placed on the platen is copied onto the standard paper. Also, as will be discussed with reference to FIG. 8, each time a copy is made, the number of copies being made which is then displayed is decremented (See step S315).

Thereafter, at step S261, if the supply of the papers from the standard paper supply port in a number equal to the inputted numerical value less 1 has been completed as indicated by YES at step S261, the supply port for the OHP blank paper is set at step S263 so that the OHP blank paper is supplied for one of the; documents on the platen which is then positioned at the A-scan position.

[2-3-2] Non-OHP Copy Mode

In this mode, in the event that the on-edge of the print key is detected (S201;YES, and, S211;YES) or that the end-edge of the paper supply is detected (S201;NO, and, S221;YES), the standard paper supply process is executed at step S231. In other words, the paper supply port specified by a key inputting or the like or by the selected mode (mode other than OHP copy mode) is selected.

Figure 8:
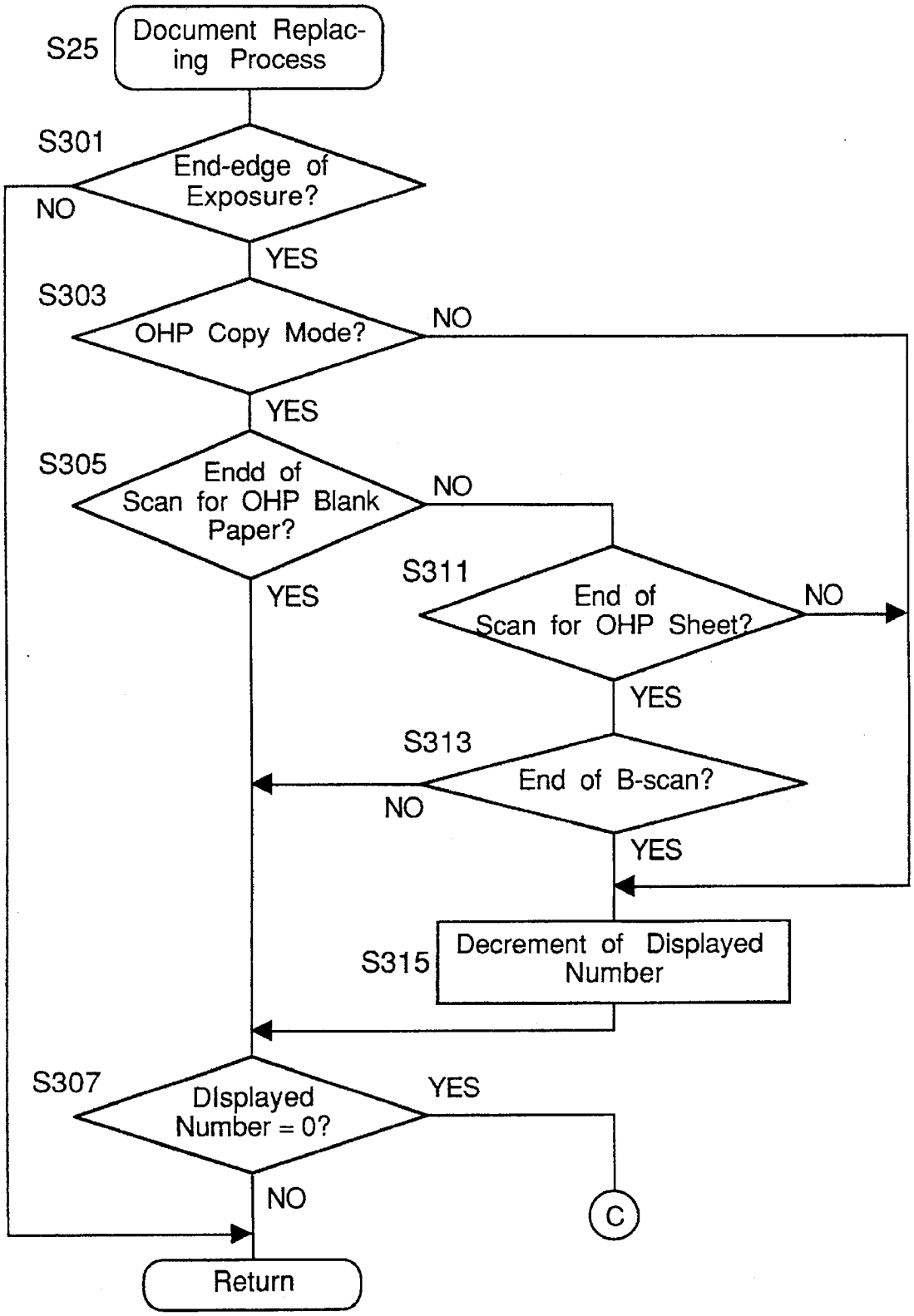
FIG. 8 is a flowchart showing a portion of a document changing routine executed by the copying machine shown in FIG. 1.
Figure 9:
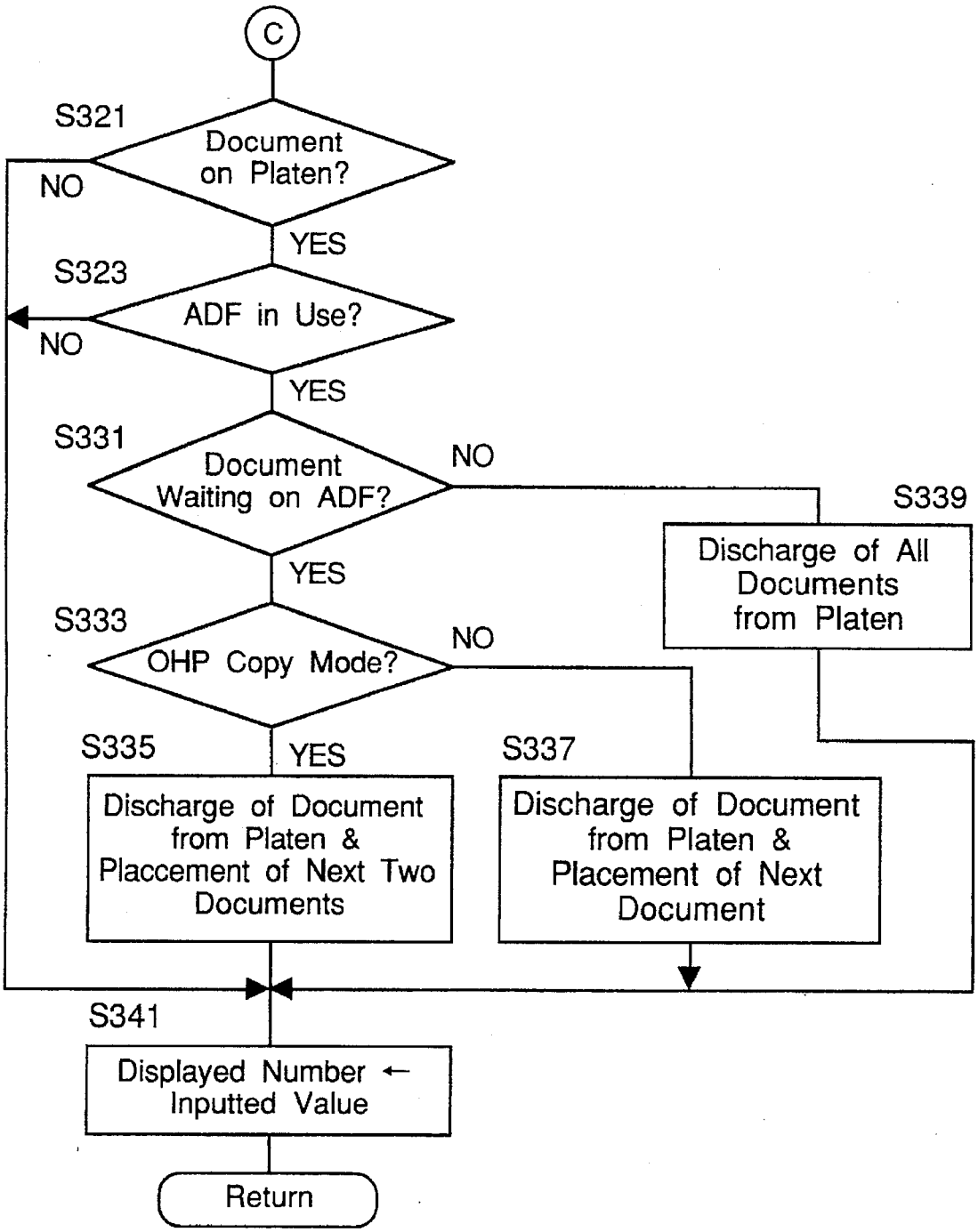
FIG. 9 is a flowchart showing the remaining portion of the document changing routine shown in FIG. 8.

[2-4] Document Replacing Process (FIGS. 8 and 9)

[2-4-1] OHP Copy Mode

When the end-edge of exposure is detected the first time as indicated by YES at step S301, decision is made to determine if the OHP copy mode is set. Since in this case the OHP copy mode is set as indicated by YES at step S303, the program flow proceeds to step S305. At step S305, decision is made to determine of the scan then completed was a scan associated for the OHP blank paper. Since at the initial time the scan associated with the OHP blank paper is completed as indicated by YES at step S305 and the displayed desired number of copies remains unchanged and exactly corresponds to the inputted value of the number of copies desired to be made, the program flow returns to the main routine.

In the event that the end-edge of the exposure is detected the second time (S301;YES, and, S303;YES), it means that the scan associated with the OHP sheet has been completed (S305;NO, and, S311;YES), the program flow proceeds to step S313. At step S313, decision is made to determine if the scan then completed is a scan of the document held at the B-scan position. Since at the outset the scan is carried out with respect to the document held at the A-scan position as indicated by NO at step S313, the program flow returns to the main routine through step S307.

In the event that the end-edge of the exposure is detected the third time (i.e., after the A-scan for the OHP sheet) (S301;YES, and, S303;YES), it means that the scan for the OHP blank paper associated with the document held at the B-scan position is completed as indicated by "YES" at step S305 and since no change is seen in the displayed number of copies desired as indicated by "NO" at step S307, the program flow returns to the main routine.

In the event that the end-edge of the exposure is detected the fourth time (i.e., subsequent to the B-scan for the OHP blank paper) (S301;YES, and, S303;YES), it means that the B-scan for the OHP sheet is completed (S305;NO, and, S311;YES, and, S313;YES) and, therefore, the displayed number of copies desired is decremented at step S315. In this way, the four scans from the A-scan for the OHP blank paper to the B-scan for the OHP sheet are treated as one shot for the multi-copying operation with respect to the documents held at the A-scan and B-scan positions. Thereafter, the program flow returns to the main routine by way of decision step S307.

Each time one shot scan associated with OHP (i.e., four scans) is completed, a wait is made until the copying operation with respect to the standard copying papers (the 2-in-1 mode copying operation) is completed and subsequently the two documents on the platen are discharged in the following manner. Simultaneously therewith, the next succeeding two documents to be copied are supplied onto the platen and laid in side-by-side fashion.

In the first place, each time the end-edge of the exposure is detected (S301;YES, and, S303;YES, and, S305;NO, and, S311;NO), the displayed number of copies desired is decremented at step S315. As a result thereof, when the displayed number of copies desired becomes zero as indicated by "YES" at step S331 indicating that the scan (2-in-1 mode scan) of the two documents on the platen has completed, the program flow goes to step S321 and so on.

In other words, where the documents remain on the platen as indicated by "YES" at step S321, the ADF is being used as indicated by "YES" at step S323, the next documents are waiting in the ADF as indicated by "YES" at step S331 and the machine is set in the OHP copy mode as indicated by "YES" at Step S333, the next documents are set on the platen in side-by-side fashion at step S335 after the documents on the platen have been discharged. Thereafter, the displayed number of copies desired is returned to the inputted value (the number of copies desired which has been inputted) at step S341.

On the other hand, where the documents remain on the platen as indicated by "YES" at step S321, and no next document is waiting in the ADF as indicated by "NO" at step S331 even though the ADF is being used as indicated by "YES" at step S323, the displayed number of copies desired is returned to the inputted value (the number of copies desired which has been inputted) at step S341 after the documents on the platen have been discharged. [2-4-2] Non-OHP Copy Mode When the end-edge of the exposure is detected during this mode (S301;YES, and, 8303;NO), the displayed number is decremented at step S315 each time it is detected. When the displayed number subsequently becomes zero as indicated by "YES" at step S307, the program flow goes to step S321.

In other words, where the documents remain on the platen as indicated by "YES" at step 8321, the ADF is being used as indicated by "YES" at step S323, the next documents are waiting in the ADF as indicated by "YES" at step S331, but the machine is not set in the OHP copy mode as indicated by "NO" at step S333, the next single document is set on the platen at step S337 after the documents on the platen have been discharged. Thereafter, the displayed number of copies desired is returned to the inputted value (the number of copies desired which has been inputted) at step S341.

Figure 10:
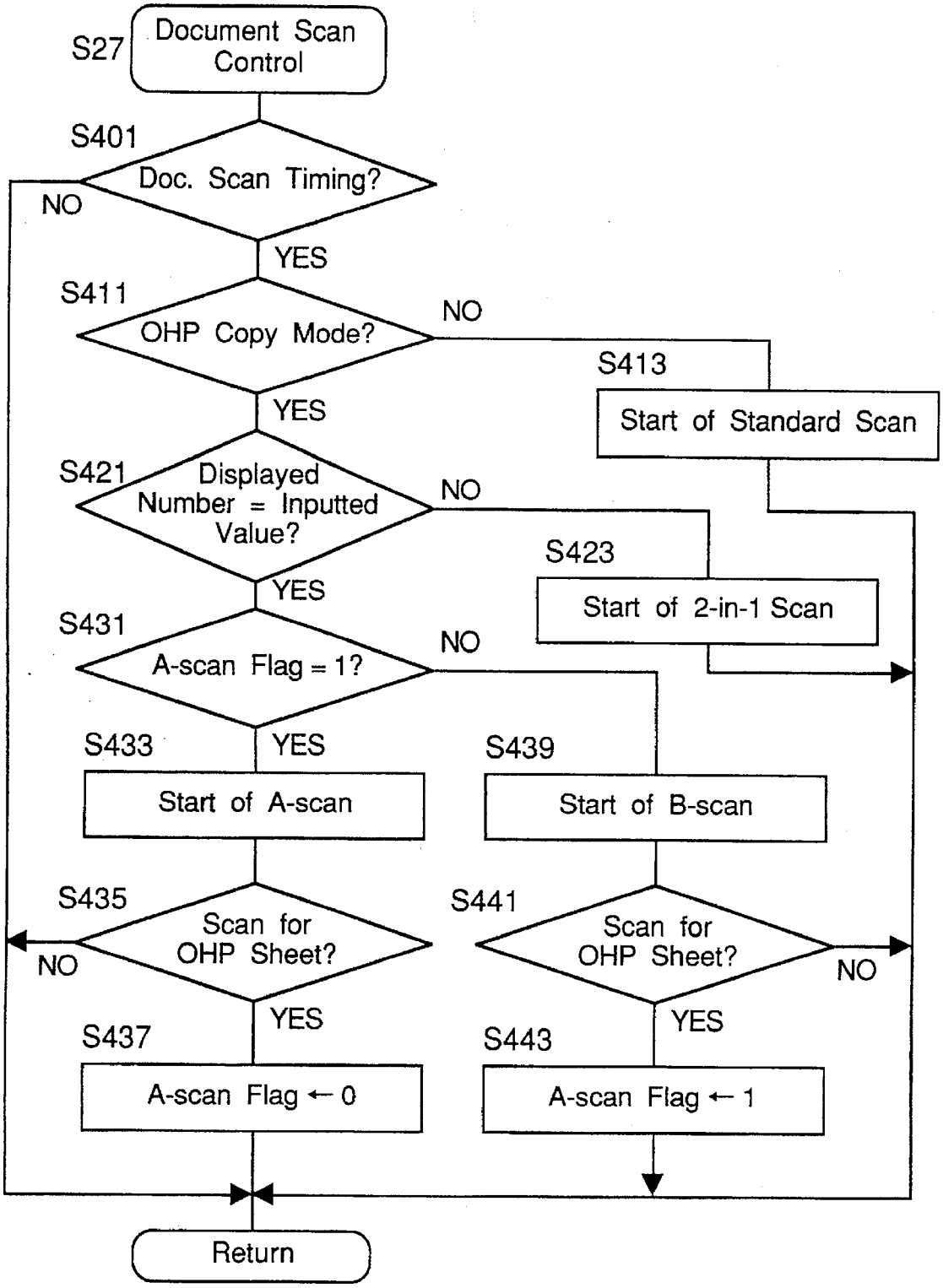
FIG. 10 is a flowchart showing a document scan control routine executed by the copying machine according to the first preferred embodiment of the present invention.

[2-5] Document Scan Control (FIG. 10)

[2-5-1] OHP Copy Mode

When time comes to scan the document as indicated by "YES" at step S401, decision is made at step S411 to determine if the OHP copy mode is enabled. Since in such case the OHP copy mode is enabled as indicated by "YES" at step S411, the program flow goes to step S421 at which decision is made to determine if the displayed number of copies is equal to the inputted value. Since as hereinbefore discussed the displayed number is decremented each time the four scans from the A-scan for the OHP blank sheet to the B-scan for the OHP sheet have been completed (See FIG. 8), a result of decision at step S421 indicates "YES", that is, the displayed number is equal to the inputted value. Consequently, the program flow goes to step S431.

At the outset, since the A-scan flag is 1 the first time as indicated by "YES" at step S431, the A-scan is initiated at step S433 and, since it is the scan for the OHP blank paper, but not for the OHP sheet, as indicated by "NO" at step 435, the program flow returns to the main routine.

Since at the second time (after the A-scan for the OHP blank paper) the A-scan flag is 1 as indicated by "YES" at step S431, the A-scan is initiated at step S433. However, since it is the scan for the OHP sheet as indicated by "YES" at step S435, the program flow returns to the main routine after the A-scan flag has been rendered to be zero at step S437.

Also, since the A-scan flag is zero the third time (after the A-scan for the OHP sheet) as indicated by "NO" at step S431, the B-scan is initiated at step S439 and, since it is the scan for the OHP blank paper, but not for the OHP sheet, as indicated by "NO" at step S445, the program flow returns to the main routine.

Since at the fourth time (after the A-scan for the OHP blank paper) the A-scan flag is zero as indicated by "NO" at step S431, the B-scan is initiated at step S439, but since it is the scan for the OHP sheet as indicated by "YES" at step S441, the program flow returns to the main routine after the A-scan flag is rendered to be 1 at step S443.

When the four scans associated with OHP are completed in this way, the displayed number is decremented as hereinabove described (See FIG. 8) and, therefore, a result of decision at step S421 indicates "NO". For this reason, the scan under the 2-in-1 copy mode is carried out hereinafter at step S423. In other words, the scan under the 2-in-1 copy mode continues until the displayed number is reset to the inputted value (See step S341 in FIG. 9). The copy made wherein documents located at the a-scan position and the B-scan position are copied separately is referred to as the divided copy mode.

[2-5-2] Non-OHP Copy Mode

When during this mode (S411;NO) time comes for the document to be scanned as indicated by "YES" at step S401, the standard or normal scan is carried out at step S413.

Figure 11:
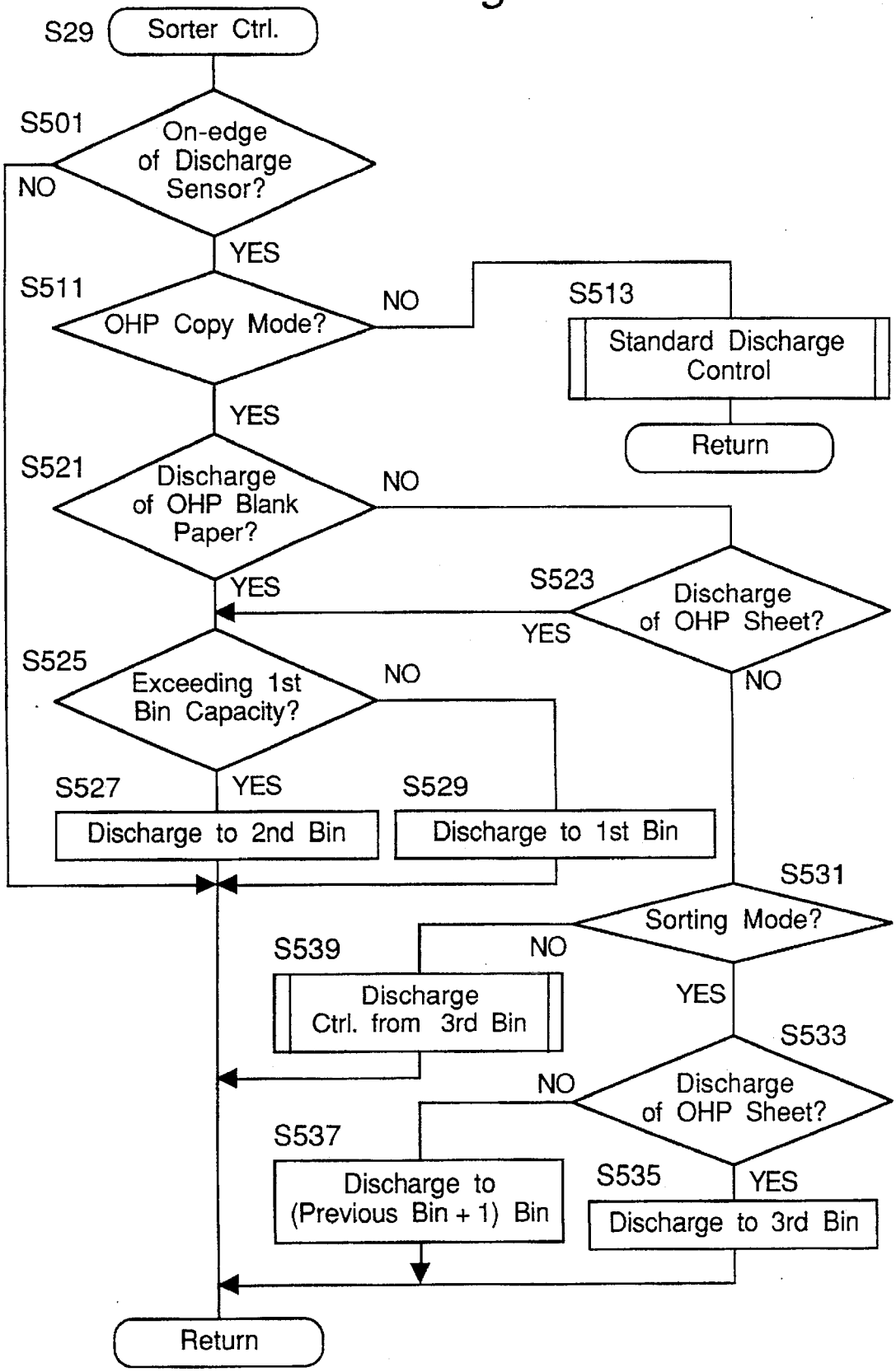
FIG. 11 is a flowchart showing a sorter control routine executed by the copying machine according to the first preferred embodiment of the present invention.

[2-6] Sorter Control (FIG. 11)

[2-6-1] OHP Copy Mode

When discharge of the paper from this copying machine is detected as indicated by "YES" at step S501, decision is made to determine if the OHP copy mode is set. Since in this case the OHP copy mode is set as indicated by "YES" at step S511, the program flow goes to step S521 at which decision is made to determine if the paper discharged from the copying machine is the OHP blank paper. Since at the first time the OHP blank paper is discharged as indicated by "YES" at step S521, the discharged paper is discharged into the first bin (copy receiving tray 43) on the condition that the capacity of the first bin (tray 43) is not exceeded, followed by return of the program flow to the main routine.

Similarly, when the OHP sheet is discharged from the copying machine (S501;YES, and, S511;YES, and, S521;NO, and, S523;YES), the OHP sheet is discharged onto the first bin (tray 43) on the condition that the capacity of the first bin (tray 43) is not exceeded, followed by return of the program flow to the main routine.

Figure 12A:
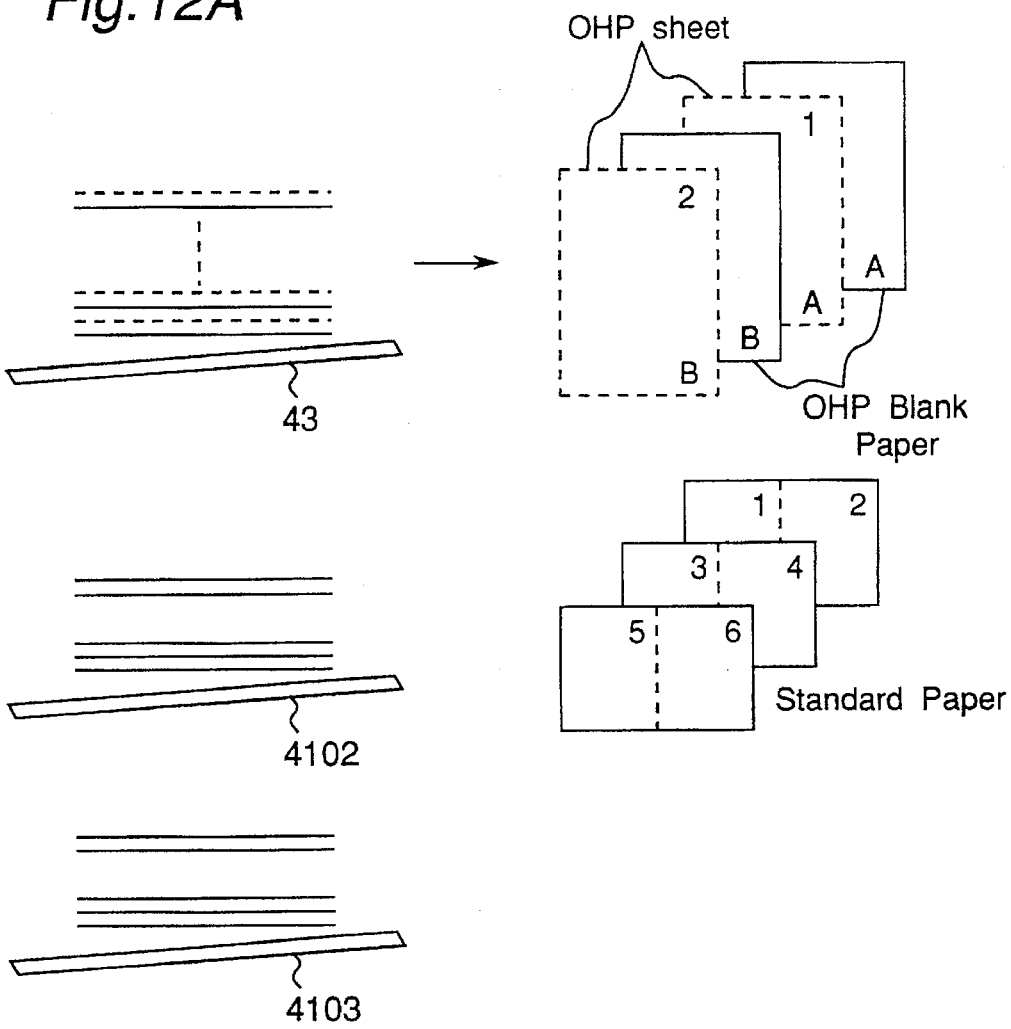
FIG. 12A is a diagram showing the sequence of placement of sheets on a sorter tray.
Figure 12B:
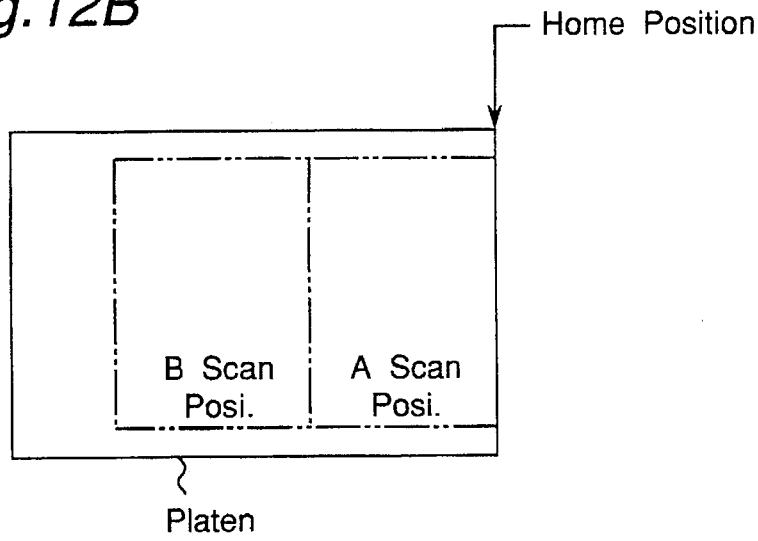
FIG. 12B is a diagram showing the manner in which a document to be copied is placed on a document support platen.

In this way, the OHP blank paper and the OHP sheet are successively discharged and then stacked on the first bin (tray 43) as shown in an upper portion of FIG. 12A, alternating with each other. It is to be noted that reference characters "A" and "B" shown in FIG. 12A represents the A-scan and the B-scan, respectively, and reference numerals 1 and 2 used in FIG. 12A represents respective images of the first and second documents.

In the event that the standard coping paper is discharged following completion of discharge of the four papers (OHP blank papers and OHP sheets) associated with OHP (S501;YES, and, S511;YES, and, S521;NO, and S523;NO), a discharge control is carried out according to the sorting mode. In other words, where the sorting mode is set as indicated by "YES" at step S531, the copies are successively discharged onto the third bins (second trays 4102) at steps S533 to S537 with the copies stacked in a fashion shown in a lower portion of FIG. 12A. It is to be noted that reference numerals 1 to 6 represent respective images of the first to sixth documents. On the other hand, where no sorting mode is set as indicated by "NO" at step S531, a control is carried out at step S539 to make it possible to appropriately discharge the copies onto the third bins (second trays 4102) according to a discharge mode.

Should the number of the papers associated with OHP, that is, the OHP blank papers and the OHP sheets, exceeds the capacity of the first bin (tray 43) as indicated by "YES" at step S525, the papers associated with OHP are discharged onto the second bin (first tray 4101) at step S527.

In the foregoing embodiment, control has been made so that the OHP blank papers and the OHP sheets are discharged onto the first bin (tray 43) and, when the number of the papers on the first bin (tray 43) exceeds the capacity of the first bin, the OHP blank papers and the OHP sheets are discharged onto the second bin (first tray 4101) and so that the standard papers are discharged onto the third bin (second tray 4102) and the following bins according to the discharge mode set in the copying machine. It is, however, pointed out that setting of the bins may be chosen as desired. By way of example, the first bin may be set as the first bin 4101, not the tray 43. Also, only one, or three, of the bins may be allocated for receiving the OHP blank papers and the OHP sheets if so desired.

[2-6-2] Non-OHP Copy Mode

During this mode, the standard discharge control is carried out at step S513. In other words, a control for discharging the copies appropriate to the discharge mode specified by key inputting (non-sorting mode, sorting mode, grouping mode, or sort & staple mode).

[2-7] Summary

As hereinbefore described, in the copying machine according to the first preferred embodiment of the present invention, when a multi-copy command is issued while the OHP copy mode is set, a process takes place to stack the OHP blank papers and the OHP sheet bearing the image of the document in an alternating fashion and, with respect to the standard papers, a multiple copy making (multi-copy operation) to produce a number of copies that is equal to the inputted value less 1 is automatically carried out Under the 2-in-1 copy mode.

In other words, if one desires that the OHP blank papers and the OHP sheets bearing the image of the document are so discharged as to be stacked one above the other in an alternating fashion with each OHP blank paper intervening between the adjoining OHP sheets and, at the same time, standard copies of the image of the same document copied in the 2-in-1 copy mode are to be made available for distribution to the audience, these two requirements can be met if the copying machine is structured as to comprise a multi-copy control means for treating the value inputted through a numerical input means, as the number of copies desired to be made for each document; an OHP copy mode input means for issuing a command necessary to set an OHP copy mode so that the OHP blank papers and the OHP sheets bearing the image of the document are alternately stacked on a copy receiving tray; and a control means which, when the OHP copy mode is set and the multi-copy command is issued, a process under the OHP copy mode is carried out relative to the OHP blank papers and the OHP sheets, but a process under the 2-in-1 copy mode is carried out relative to the standard papers a number of times determined by the value inputted through the numerical input means.

On the other hand, if one desires only the OHP sheets bearing the image of a document and copies made under the 2-in-1 copy mode for distribution to, for example, the audience, this requirement can be met if the copying machine is so structured as to comprise a multi-copy control means for treating the value inputted through a numerical input means, as the number of copies desired to be made for each document; an OHP copy mode input means for issuing a command necessary to set an OHP copy mode so that the image of the document is copied onto the OHP sheets; and a control means which, when the OHP copy mode is set and the multi-copy command is issued, a process under the OHP copy mode is carried out relative to the OHP sheets, but a process under the 2-in-1 copy mode is carried out relative to the standard papers a number of times determined by the value inputted through the numerical input means, It is to be noted that the magnification factor at which a copy is made under the 2-in-1 copy mode may be an "equal size" (in this case, papers of a size double the size of the OHP sheet are required) or a "reduced size (in the case of 50% reduction, papers of a size equal to that of the OHP sheet, but of an orientation different from that of the OHP sheet are required).

Second Embodiment. (FIGS. 1 to 4 and 13 to 17)

[1] Copying Machine

Figure 13:
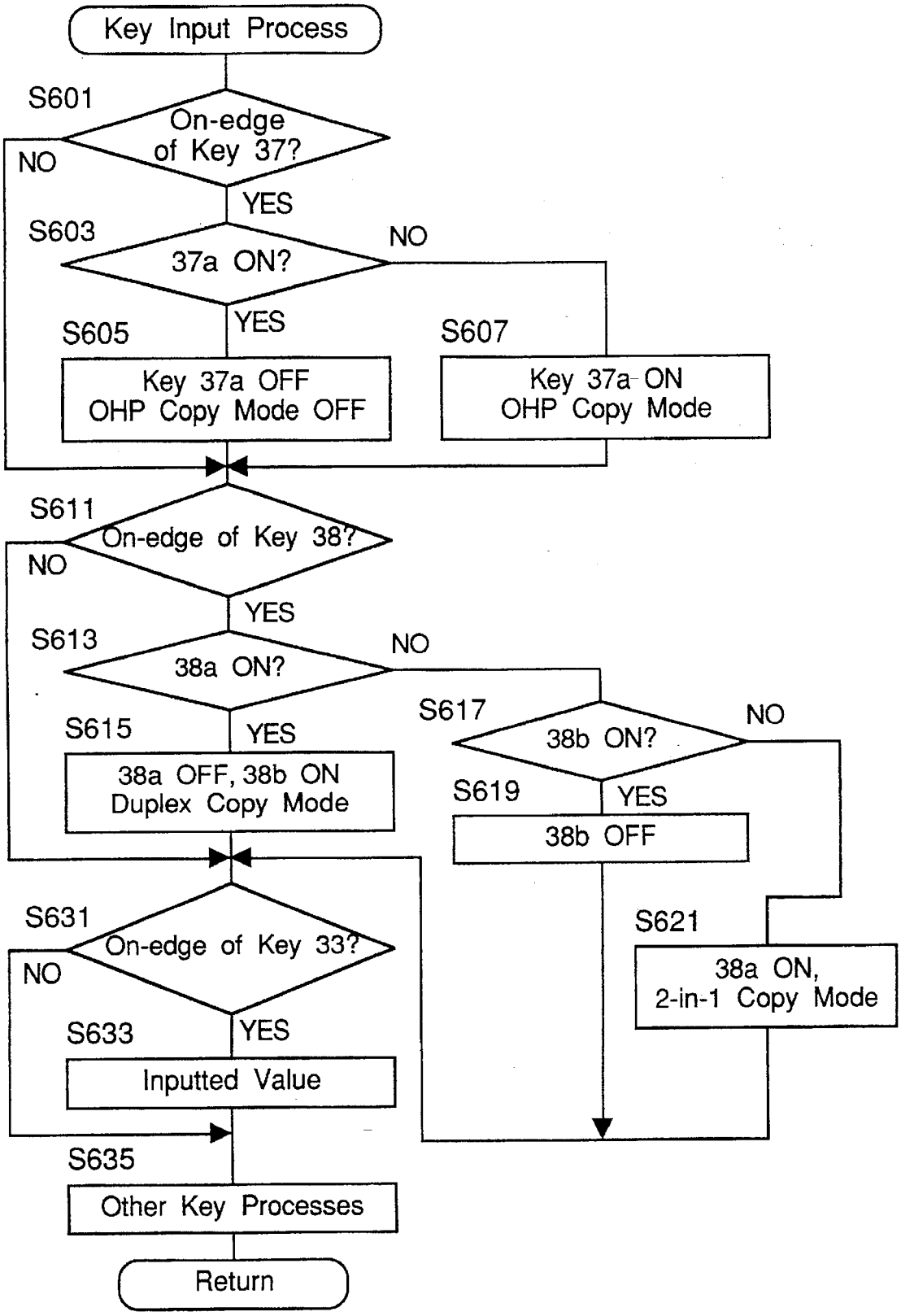
FIG. 13 is a flowchart showing the key input processing routine according to a second preferred embodiment of the present invention.
Figure 14:
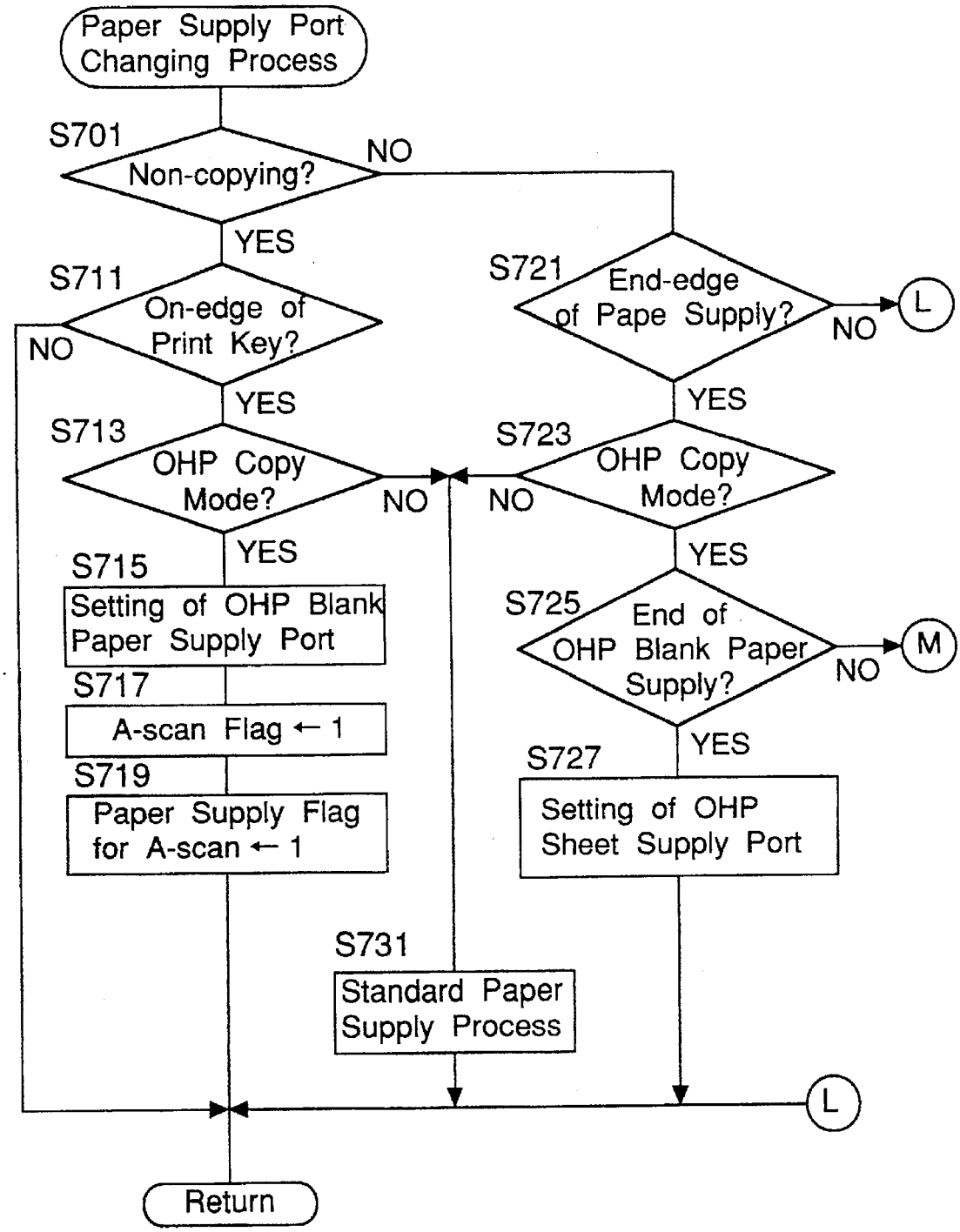
FIG. 14 is a flowchart showing a portion of the cassette changeover routine according to the second preferred embodiment of the present invention.
Figure 15:
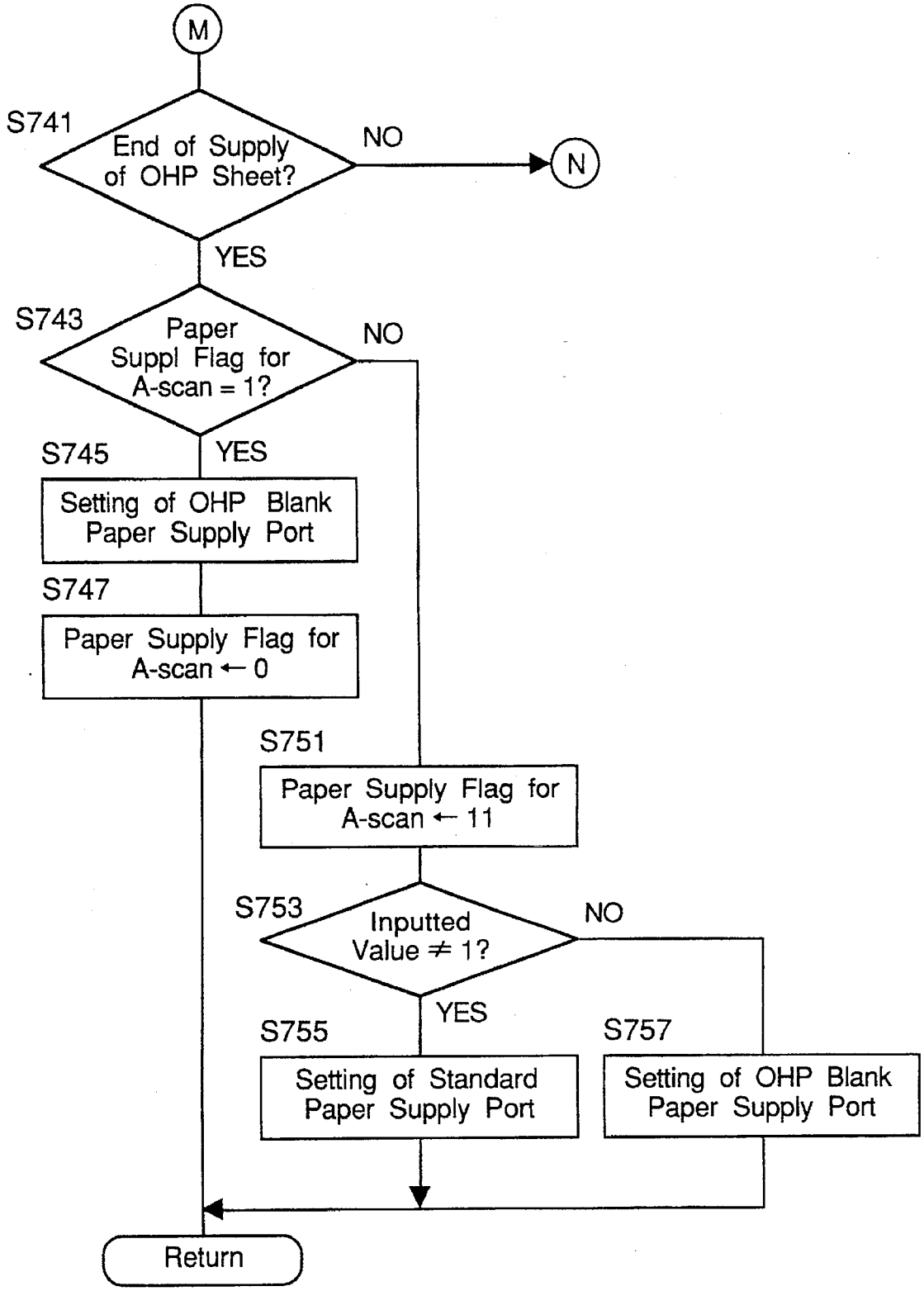
FIG. 15 is a flowchart showing another portion of the cassette changeover routine shown in FIG. 14.
Figure 16:
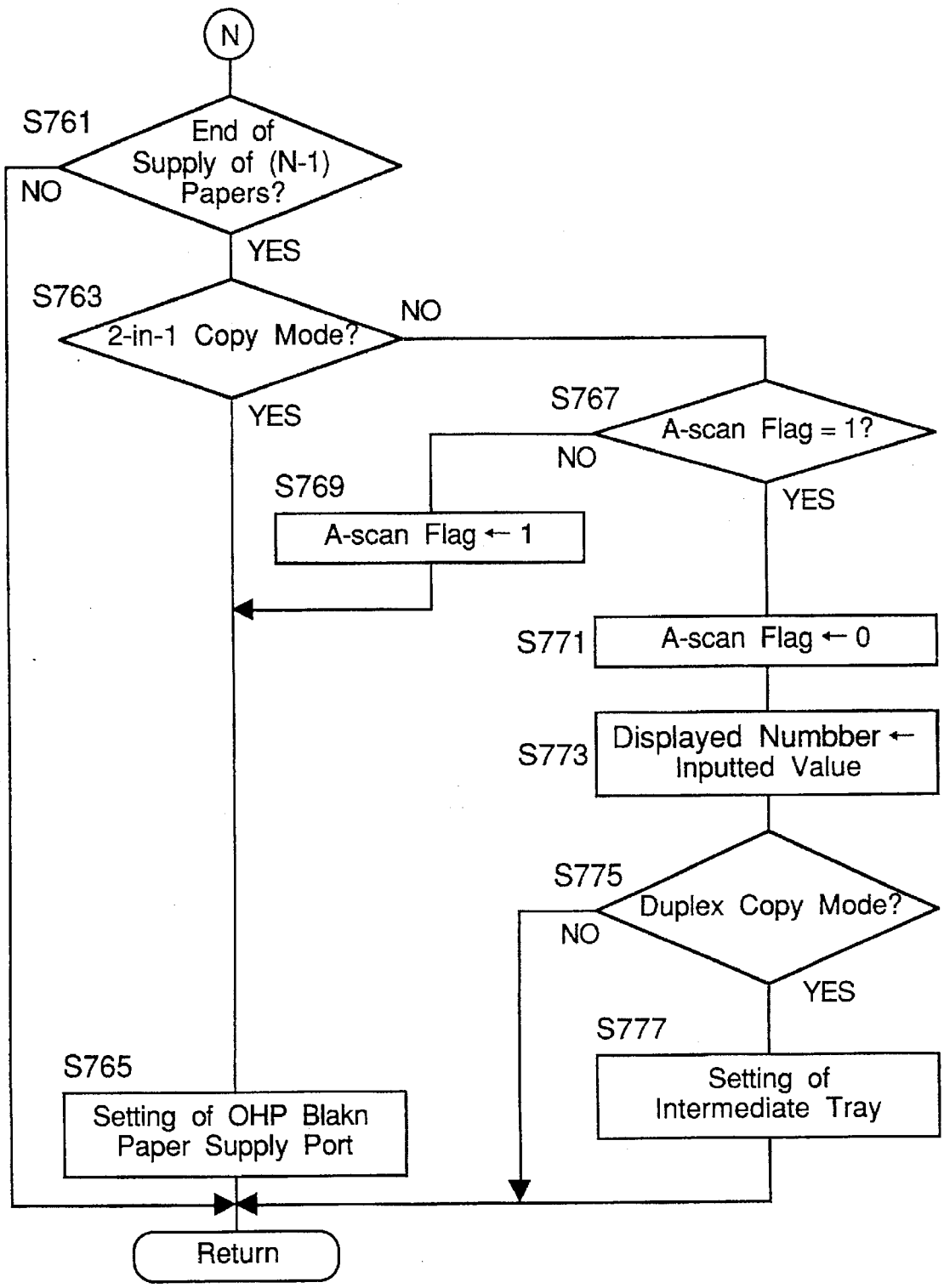
FIG. 16 is a flowchart showing the remaining portion of the cassette changeover routine shown in FIG. 14.
Figure 17:
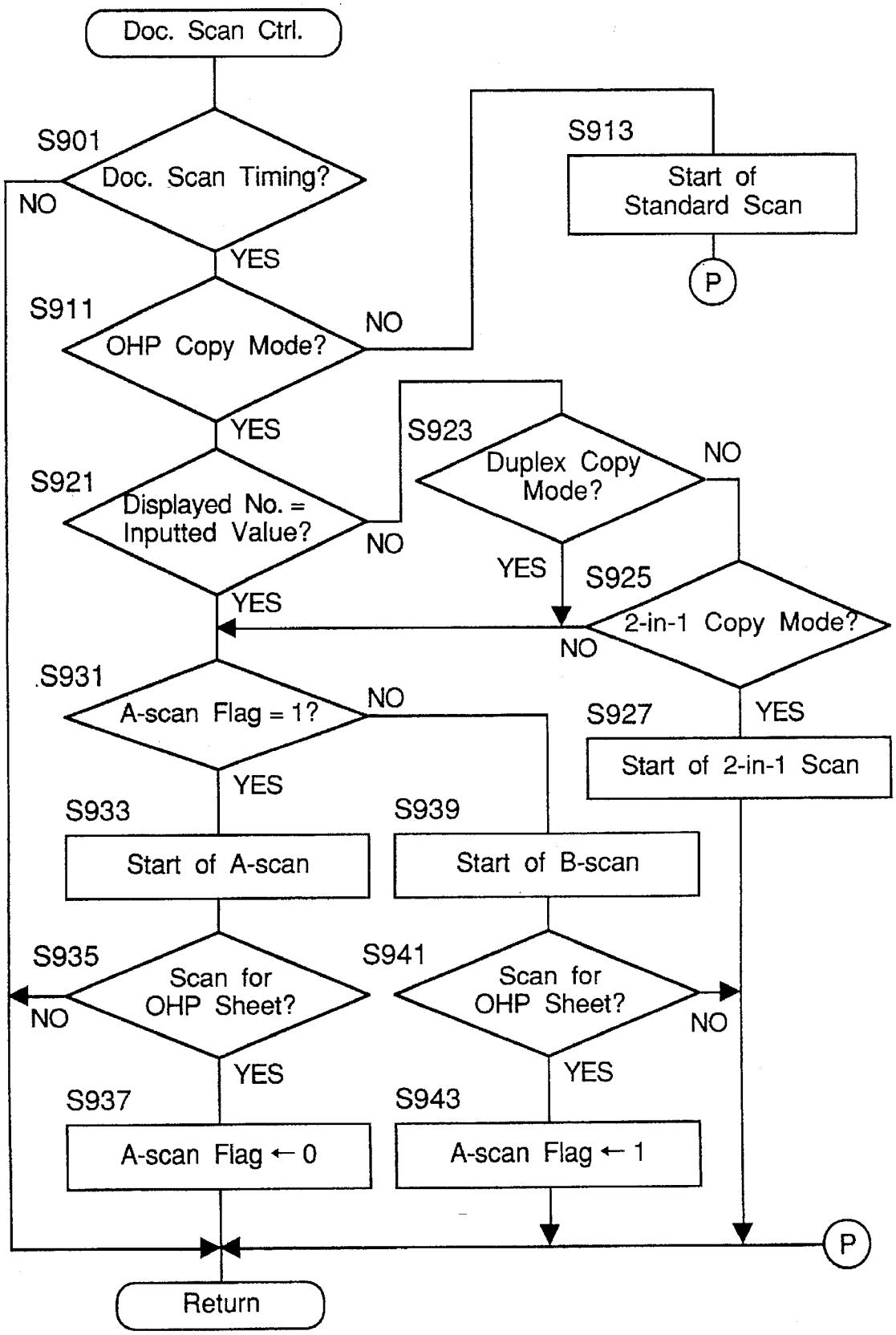
FIG. 17 is a flowchart showing the document scan control routine according to the second preferred embodiment of the present invention.

The copying machine used in the practice of the second preferred embodiment of the present invention is identical with that used in the first preferred embodiment except that, in place of the 2-in-1 mode key 36 and the 2-in-1 mode indicator 36*a*, the 2-in-1/duplex/standard copy mode selector key 38 and the LED indicators 38*a* and 38*b* are employed as shown by the phantom circles in FIG. 2. The 2-in-1/duplex/standard copy mode selector key 38 is a selector key capable of selecting one of the 2-in-1 copy mode, the duplex copy mode and the standard copy mode sequentially in rotation. The LED indicators 38*a* and 38*b* are adapted to be lit when the 2-in-1 copy mode and the duplex copy mode are selected, respectively, to provide associated visual indications. Steps S601, S603, S605, S607, S613, S631, S633, and S635 of the second embodiment shown in FIG. 13 are similar to the steps of the first embodiment shown in FIG. 5. In addition, steps S711, S713, S715, S717, S719, S727, and S731 of FIG. 14 are similar to the steps of the first embodiment shown in FIG. 6, steps S745 and S757 of FIG. 15 are similar to those of the first embodiment shown in FIG. 7, and steps S913, S927, S935, S937, and S941 of FIG. 17 are similar to the steps of the first embodiment shown in FIG. 10.

[2] Control of Copying Machine

According to the second embodiment of the present invention, the 2-in-1 copy mode, the duplex copy mode and the standard copy mode are independently selected. In other words, during the OHP copy mode, the documents are set at the A-scan and B-scan positions, respectively, and a process associated with the OHP blank papers and a process associated with the OHP sheets are carried out with respect to the document at each of the positions. During the 2-in-1 copy mode, respective images of the two documents on the A-scan and B-scan positions are copied on the standard papers in a number equal to the inputted value less 1. During the duplex copy mode, the image of the document at the A-scan position is copied on one side of each of the standard papers in a number equal to the inputted value less 1 and, thereafter, the image of the document at the B-scan position is copied on the opposite side of each of such standard papers.

By way of example, when the OHP copy mode and the 2-in-1 copy mode are selected, after the process associated with the OHP blank papers and the OHP sheets, a 2-in-1 copy is made on the standard papers in a number equal to the inputted value less 1. However, when the OHP copy mode and the duplex copy mode are selected, after the process associated with the OHP blank papers and the OHP sheets, the A-scan is carried out to make a copy on one side of the standard papers in a number equal to the inputted value less 1, which papers are subsequently fed to the intermediate tray, and subsequently the B-scan is carried out to make a copy on the opposite side of the standard paper once accommodated in the intermediate tray in the number equal to the inputted value less 1. Finally, when the OHP copy mode and the standard copy mode are selected, after the process associated with the OHP blank papers and the OHP sheets, the A-scan is carried to make copies on the standard papers in a number equal to the inputted value less 1 and, thereafter, the B-scan is carried out to make copies on the standard papers in a number equal to the inputted value less 1.

It is to be noted that, in the practice of the second preferred embodiment of the present invention, it is possible to select the 2-in-1 copy mode and the duplex copy mode without selecting the OHP copy mode and, in such case, the 2-in-2 copy mode and the duplex copy mode take place in manner identical with those hitherto practiced.

[2-1] Main Routine (FIG. 4)

The main routine is identical with that described in connection with the first embodiment of the present invention, except that the key input process at step S21, the paper supply port changing process at step S23 and the document scan control at step S27 are carried out in the following manner.

[2-2] Key Input Process (FIG. 13)

This key input process used in the practice of the second embodiment of the present invention is substantially similar to that used in the first embodiment, but differs therefrom in that one of the 2-in-1 copy mode, the duplex copy mode and the standard copy mode can be selected depending on an input from the 2-in-1/duplex/Standard copy mode selector key 38. In other words, when the on-edge of the 1-in-1/duplex/standard copy mode selector key 38 is detected as indicated by "YES" at step S611, and in the event that the LED indicator 38*a* is turned on, the LED indicator 38*a* is turned off and the LED indicator 38*b* is turned on. In other words, the 2-in-1 copy mode is released and the duplex copy mode is set at step S615.

On the other hand, when the on-edge of the 1-in-1/duplex/standard copy mode selector key 38 is detected as indicated by "YES" at step S611, and in the event that the LED indicator 38*b* is turned on as indicated by "YES" at step S617, the LED indicator 38*b* is turned off and the duplex copy mode is released at step S619, allowing the standard copy mode to resume.

Also, when the on-edge of the 2-in-1/duplex/standard copy mode selector key 38 is detected as indicated by "YES" at step S611, and in the event that both of the LED indicators 38*a* and 38*b* are turned off as indicated by "NO" at step S617, the LED indicator 38*a* is turned on and the 2-in-1 copy mode is set at step S621.

[2-3] Paper Supply Port Changing Process and Document Scan Control (FIGS. 14 to 17)

Hereinafter, the paper supply port changing process and the document scan control are collectively described.

[2-3-1] OHP Copy Mode and 2-in-1 Copy Mode:

Since this is executed in a manner similar to that in the first embodiment of the present invention, the description thereof is not reiterated for the sake of brevity.

[2-3-2] OHP Copy Mode and Duplex Copy Mode

The process associated with the OHP blank papers and the OHP sheets is identical with that in the first embodiment of the present invention. More specifically, during execution of the paper supply port changing process, the paper supply ports are sequentially switched from the OHP blank paper supply port to the OHP sheet supply port, then from the OHP sheet supply port to the OHP blank paper supply port and from the OHP blank paper supply port to the OHP sheet supply port and so forth. Also, in correspondence with the switching of the paper supply ports described above, the document scan control is also sequentially carried out in the order from the A-scan, the A-scan, the B-scan and the B-scan.

When after completion of the previously described four scans associated with OHP the end-edge of supply of the OHP sheet supplied for the B-can is detected (S701;NO, and, S721;YES, and, S723;YES, and, S725;NO, and, S741;YES), and since at this time the A-scan paper supply flag is rendered to be 0 during the previous execution of step S747 as indicated by "NO" at step S743, the program flow goes to step S751, rendering the A-scan paper supply flag to be 1 at step S751. Then, as is the case with the first embodiment of the present invention, the standard paper supply port is set at step S755 as a paper supply port on the condition that the multi-copy mode is selected as indicated by "YES" at step S753.

With respect to each of the papers of a number equal to the inputted value less 1 that are supplied from the standard paper supply port set at step S755, the A-scan is carried out. In other words, as shown in FIG. 17, at a document scanning timing as indicated by "YES" at step S901, since although the OHP copy mode is set as indicated by "YES" at step S923, but the displayed number is not equal to the inputted value as indicated by "NO" at step S921, the duplex copy mode is set as indicated by "YES" at step S923, the program flow goes to step S931 at which decision is made of the A-scan flag. Since at this time the A-scan flag is rendered to be 1 at step S943 subsequent to start of the B-scan of the OHP sheet, a result of decision at step S931 is "YES" and, therefore, the A-scan is carried out at step S933. It is to be noted that the papers of a number equal to the inputted value less 1, onto which the image of the document have been copied, are successively accommodated within the intermediate tray 14 with the image bearing side thereof oriented upwardly.

Since the papers are supplied from the standard paper supply port in this way, when the subsequent end-edge of supply of the paper is detected next time (S701;NO, and, S721;YES, and, S723;YES, and, S725;NO), a result of decision at step S741 will indicate "NO" and the program flow goes to step S761 at: which decision is made to determine if the papers have been supplied in a number equal to the inputted value less 1 from the standard paper supply port. If a result of decision at step S761 indicates that it has not yet been completed as indicated by "NO", the program flow returns to the main routine and repeats until it has been completed. In other words, the image of the document at the A-scan position is copied on the standard paper which is subsequently accommodated in the intermediate tray 14 with the image bearing side thereof oriented upwardly. Also, as discussed with reference to FIG. 8, the displayed number is decremented at step S315 each time the copy has been made.

When a result of decision at step S761 subsequently indicates "YES", the following process takes place so that the supply of the next succeeding paper is carried out from the intermediate tray 14.

That is, since in this case the 2-in-1 copy mode is not set as indicated by "NO" at step S763, the program flow goes to step S767 at which decision is made to determine the status of the A-scan flag. As discussed hereinabove, the A-scan flag is set to be 1 as indicated by "YES" at step S767 and, therefore, the A-scan flag is rendered to be zero at step S771 so that the subsequent scan will be the B-scan. Then, the displayed number is reset to the inputted value at step S773. Also, the program flow goes to step S775 at which decision is made to determine if the duplex copy mode is selected. Since at this time the duplex copy mode is set as indicated by "YES" at step S775, the paper supply port of the intermediate tray 14 is set as the paper supply port at step S777.

As a result that the B-scan is set, the displayed number is reset to the inputted value and the paper supply port of the intermediate tray 14 is set as the paper supply port as hereinabove described, the subsequent operation is such that the image of the document held at the B-scan position is copied on the opposite, side of each of the standard papers in a number equal to the inputted value less 1 which have been successively supplied from the intermediate tray 14, it being to noted that one side of each standard paper has the image of the document at the A-scan position copied thereon.

In other words, when the time comes to execute the document scan as indicated by "YES" at step S901, since it means the OHP copy mode as indicated by "YES" at step S911 and, at this time, the displayed number is equal to the inputted value as indicated by "YES" at step S921 and, at the same time, the A-can flag is rendered to be zero as indicated by "NO" at step S931, the B-scan is carried out at step S939.

Also, although at the subsequent document scanning timing as indicated by "YES" at step S901 the OHP copy mode is set as indicated by "YES" at step S911, the displayed number is different from the inputted value since it has been decremented at step S315 and, for this reason, a result of decision at this step 921 indicates "NO". However, since the duplex copy mode is set as indicated by "YES" at step S923, the program flow goes to step S931 after all and the B-scan is carried out accordingly at step S939 in a manner similar to the foregoing (S931;NO).

When the papers are supplied from the intermediate tray 14 in a number equal to the inputted value less 1 and the end-edge of supply of the last one of the papers is subsequently detected (S701;NO, and, S721;YES, and, S723;YES, and, S725;NO, and, S741;NO), decision takes place again at step S761, followed by flow to the step S767. Since, however, the A-scan flag has already been set to zero at step S771 as hereinabove described (S767;NO), the A-scan flag is rendered to be 1 at step S769 so that the third scan will be the A-scan and, thereafter, the OHP blank paper supply port is set as the paper supply port at step S765. This is for the purpose of accommodating the document set at the A-scan position subsequent to the discharge of the document then placed on the platen.

In this way, the process completes one cycle.

[2-3-3] OHP Copy Mode and Standard Copy Mode

A process substantially identical with the previously described "OHP Copy mode and Duplex Copy Mode" is carried out.

More specifically, during execution of the supply port changing process, the paper supply port changes in this order from the OHP blank paper supply port to the OHP sheet supply port, then from the OHP sheet supply port to the OHP blank paper supply port, and finally from the OHP blank paper supply port to the OHP sheet supply port. In association with change of the paper supply port, during the document scan control, the scanning takes place one after another in this order of the A-scan, the A-scan, the B-scan and the B-scan.

Then, the papers in a number equal to the inputted value less 1 are successively supplied from the standard paper supply port and are successively Copied with the image of the document held at the A-scan position before they are discharged to the outside of the copying machine.

The process so far described above is substantially identical with that discussed in connection with the "OHP Copy mode and Duplex Copy Mode".

Thereafter, the papers are successively supplied from the standard paper supply port in a number equal to the inputted value less 1 and are discharged to the outside of the copying machine after the image of the document held at the B-scan position has been copied thereon. This is realized when the flow goes to step S931 while the A-scan flag remains zero (See step S771 ) and the intermediate tray 14 is not set (See "NO" at step S775) and, at the same time, the machine is set under the standard copy mode (S923;NO, and, S925;NO) even though the displayed number determined at step S921 in FIG. 17 does not read zero. In this way, the process completes one cycle.

In other words, the "OHP Copy Mode and Standard Copy Mode" discussed above is substantially identical with the previously discussed "OHP Copy mode and Duplex Copy:Mode", except that the standard papers onto which the image of the document held at the A-scan position are discharged to the outside, of the copying machine in a number equal to the inputted value less 1 and that the standard papers supplied from the standard paper supply port, not from the intermediate tray 14, are copied with the image of the document held at the B-scan position.

[2-4] Summary

Thus, in the copying machine according to the second preferred embodiment of the present invention, when the multi-copy command is issued while the machine is set under the OHP copy mode, a process takes place so that on the copy receiving tray the OHP blank papers and the OHP sheets bearing the image of the document are stacked alternately, but with respect to the standard papers multiple copies of a number equal to the inputted value less 1 are produced automatically under a mode selected by the 2-in-1/duplex/standard copy mode selector key 38.

In other words, if one desires that the OHP blank papers and the OHP sheets bearing the image of the document are so discharged as to be stacked one above the other in an alternating fashion with each OHP blank paper intervening between the adjoining OHP sheets and, at the same time, standard copies of the image of the same document copied in the 2-in-1 copy mode (or the duplex copy mode or the standard copy mode) are to be made available for distribution to the audience, these two requirements can be met if the copying machine is structured as to comprise a multi-copy control means for treating the value inputted through a numerical input means, as the number of copies desired to be made for each document; a 2-in-1 copy mode (or a duplex copy mode or a standard copy mode) input means for issuing a command necessary to set a 2-in-1 copy mode (or a duplex copy mode or a standard copy mode) so that the OHP blank papers and the OHP sheets bearing the image of the document are alternately stacked on a copy receiving tray; and a control means which, when the OHP copy mode is set and the multi-copy command is issued, a process under the OHP copy mode is carried out relative to the OHP blank papers and the OHP sheets, but a process under the 2-in-1 copy mode (or the duplex copy mode or the standard copy mode) is carried out relative to the standard papers a number of times determined by the value inputted through the numerical input means.

Although not discussed in the description of the copying machine according to the second preferred embodiment of the present invention, in place of the above described mode (the 2-in-1 copy mode, the duplex copy mode or the standard copy mode), a magnification changing mode, a margin making mode or a stapling mode may be employed so that one of these alternative modes may be executed to production of copies for distribution to, for example, the audience.

From the foregoing, it has now become clear that when a multi-copy command is issued while the OHP copy mode and the copy mode are selected, the OHP copy mode is carried out relative to the OHP blank papers and the OHP sheets, but the selected copy mode is carried out to the standard papers a number of times equal to the number of multiple copies desired. Therefore, reproduction of the image of the document on the OHP sheets and preparation of copies for distribution are carried out simultaneously. Also, the copies for distribution can advantageously be made in a layout suitable for materials for distribution to the audience.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An image forming apparatus which comprises:

image forming means for optically scanning a document to accomplish an image formation;

first accommodating means for accommodating a batch of OHP sheets;

second accommodating means for accommodating a batch of copying papers;

first setting means for setting an OHP copy mode as one operation relative to one document during which, after a copy paper supplied from the second accommodating means has been discharged, an OHP sheet is supplied from the first accommodating means and is, after an image has been formed thereon by said image forming means, discharged;

second setting means for setting a multi-copy mode in which using the copy papers accommodated in the second accommodating means a multiple copy is carried out;

third setting means for setting a copying condition; and control means for controlling the copying condition set by the third setting means so as to be applied only during the multi-copy mode, set by the second setting means, when the OHP copy mode is set by the first setting means and, at the same time, the multi-copy mode is set by the second setting means.

2. The image forming apparatus as claimed in claim 1, wherein the copying condition set by the third setting means is a 2-in-1 copy mode.

3. The image forming apparatus as claimed in claim 1, wherein the copying condition set by the third setting means is a magnification changing mode.

4. The image forming apparatus as claimed in claim 1, wherein said copying condition set by the third setting means is a duplex copy mode.

5. An image forming apparatus, comprising:

image forming means for optically scanning a document to accomplish an image formation;

first accommodating means for accommodating an OHP sheet;

second accommodating means for accommodating a batch of copying papers;

first setting means for setting an OHP copy mode in which the OHP sheet is supplied from the first accommodating means and, after an image has been formed thereon by said image forming means, is discharged;

second setting means for setting a multi-copy mode in which a multiple copy operation using the copy papers accommodated in the second accommodating means is carried out;

third setting means for setting a copying condition; and control means for controlling the copying condition set by the third setting means so as to be applied only during the multi-copy operation set by the second setting means, when both the OHP copy mode is set by the first setting means and the multi-copy mode is set by the second setting means.

6. The apparatus as defined in claim 5, further comprising fourth setting means for setting a copy mode for carrying out the OHP copy mode set by said first setting means.

7. The apparatus as defined in claim 6, wherein the copy mode is a divided copy mode.

* * * * *